United States Patent [19]

Husson

[11] Patent Number: 4,470,482

[45] Date of Patent: Sep. 11, 1984

[54] SPEED PATTERN GENERATOR FOR AN ELEVATOR CAR

[75] Inventor: Alan L. Husson, Hackettstown, N.J.

[73] Assignee: Westinghouse Electric Corp., Pittsburgh, Pa.

[21] Appl. No.: 446,149

[22] Filed: Dec. 2, 1982

[51] Int. Cl.[3] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 4,150,734 | 4/1979 | Ohira et al. | 187/29 |
| 4,155,426 | 5/1979 | Booker, Jr. | 187/29 |
| 4,220,221 | 9/1980 | Gingrich | 187/29 |
| 4,354,576 | 10/1982 | Kajiyama | 187/29 |

*Primary Examiner*—J. V. Truhe
*Assistant Examiner*—W. E. Duncanson, Jr.
*Attorney, Agent, or Firm*—D. R. Lackey

[57] ABSTRACT

A speed pattern generator, and method of generating a speed pattern, for use by an elevator car during a run to a target floor. The speed pattern includes a time based portion and a distance-to-go based portion. Calculations during the time based portion are minimized by calculating spaced points or decision speeds on the acceleration portion of the desired speed pattern. The points selected are those points at which decisions must be made as to whether the acceleration portion of the pattern should be continued. The pattern is changed at a predetermined jerk limited rate between the decision points, until a decision is made which indicates acceleration should be reduced to zero, either because the maximum desired magnitude of the speed pattern is being approached, or because the advanced floor position (AVP floor) of the elevator car has reached the target floor. A final and single calculation during the time based portion is then made, which uses the latest decision speed to calculate the desired slowdown distance for the elevator car. When the elevator car reaches the calculated slowdown distance, a distance-to-go speed pattern is generated, which is substituted for the time based pattern when the two patterns have a predetermined relationship.

27 Claims, 19 Drawing Figures

170
INTERRUPT
172
INCREMENT INTERRUPT COUNT IC
174
TREN SET
N
Y
184
PGTRMP
186
ACC (LOW) =ADES
N
188
ACC (LOW) >ADES
Y
N
Y
190
INCREMENT ACC
192
DECREMENT ACC
194
ACC (LOW) >0
N
Y
196
VPAT(HIGH) =0
N
N
198
VPAT (HIGH) =FF$_H$
Y
Y
200
VPAT ← VPAT+ACC
202
SAVE: ACC VPAT
204
OUTPUT VPAT (HIGH) TO D/A
176
IC= COUNT
N
178
PGOUT
Y
180
IC ← 0
182
JUMP TO PGLOGC

SPEED PATTERN GENERATOR FOR AN ELEVATOR CAR

BACKGROUND OF THE INVENTION

1. Field of the Invention

The invention relates in general to speed pattern generators, and more specifically to the digital generation of a speed pattern for an elevator car.

2. Description of the Prior Art

The car controller of an elevator car performs such functions as keeping track of car position and tabulating the calls for elevator service. It controls the car and hatch doors, it sets the car travel direction circuits, and it initiates a run of the elevator car to a target floor. It controls the hall lanterns, and it resets calls when they are serviced. The car controller also stops the elevator car at floor level, and it relevels the car when necessary. In addition to these functions which may be broadly called floor selector functions, it also generates a speed pattern for use by the motor controller portion of the elevator drive machine. While these functions have been performed in the past by relays, hard wire logic, and analog circuits, it is now desirable to perform them by microcomputer. The microcomputer requires little physical space, and it has a relatively low cost.

The relatively low cost of the microcomputer has resulted in segregating systems into functional sub-systems, and using a microcomputer in each sub-system. Thus, in applying microcomputers to an elevator car controller, the floor selector and speed pattern generator functions would each have its own microcomputer. This is especially true, because digital generation of a speed pattern by microcomputer involves time-consuming calculations which must be made at a rapid rate in order to provide the required precision and accuracy.

While microcomputers have a relatively low cost, each additional microcomputer used in a system adds to its cost and complexity. Thus, it would be desirable to be able to perform all of the car controller functions for an elevator car with a single microcomputer, if this result can be obtained without sacrificing the precision and accuracy of the speed pattern generator function.

SUMMARY OF THE INVENTION

Briefly, the present invention relates to new and improved speed pattern generator apparatus for an elevator car, and methods of generating a speed pattern, which apparatus and methods reduce the number of calculations required in the speed pattern function to the point where a single microcomputer can easily perform all of the car controller functions. Further, the reduction in the number of calculations has been accomplished without adversely affecting the quality or accuracy of the speed pattern produced.

More specifically, the present invention recognizes that the car controller functions are numerous and varied up until the point where the slowdown portion of an elevator car run begins. From slowdown to landing, the car controller has little to do except to generate the slowdown speed pattern. Accordingly, the present invention generates the speed pattern from initiation to the slowdown phase with only a few calculations. Instead of calculating the advanced car position during acceleration from current speed, which requires a large number of calculations per second, the present invention only makes a calculation each time the advanced car floor position (AVP floor) of the elevator car changes. When rated speed is approached, or the advanced floor position of the elevator car coincides with the target floor, whichever occurs first, the invention calculates the slowdown distance using the calculation made for the last AVP floor. The slowdown distance is only calculated once per run.

The present invention recognizes that a decision as to whether or not the acceleration portion of the speed pattern should be continued need only be made each time the advanced position of the car arrives at a new floor position. If the new floor position is the target floor, the acceleration pattern is changed by reducing acceleration to zero. If it is not the target floor, and the speed pattern is not approaching rated speed, the acceleration portion of the speed pattern may continue.

The present invention breaks the generation of the speed pattern into a plurality of functional modules controlled by a supervisory or logic module. The logic module runs periodically and calls whichever function module has a need to run at any particular instant. Another module provides a time ramp generator function, and it provides a time based speed pattern at a jerk limited rate without time-consuming calculations. The function modules merely set the parameters for the time ramp module during the time based portion of the speed pattern. When the elevator car reaches the calculated slowdown distance from the target floor, a distance based module is called which provides a distance-to-go speed pattern which is substituted for the time based speed pattern when the two patterns have a predetermined relationship. The distance based pattern requires rapid calculations, but as hereinbefore stated, the car controller has little to do during slowdown and the microcomputer can essentially dedicate itself to the speed pattern function during the relatively short landing phase of the run.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

The invention relates to new and improved speed pattern generator apparatus for an elevator system, and methods of generating a speed pattern for an elevator system. The new and improved speed pattern generator, and methods of generating a speed pattern, are described by illustrating only those parts of an elevator system which are pertinent to the understanding of the invention, with the remaining portions of the complete elevator system being incorporated by reference to issued patents assigned to the same assignee as the present application. Accordingly, U.S. Pat. Nos. 3,750,850; 4,277,825; 3,902,572; and 4,019,606 are incorporated into the specification of the present application by reference. U.S. Pat. No. 3,750,850 sets forth a car controller, including a floor selector and a speed pattern generator. The speed pattern generator of the present invention may be substituted for the speed pattern generator of this patent. U.S. Pat. No. 4,277,825 discloses elevator drive machine control which may utilize the speed pattern generated by the speed pattern generator of the invention to control the speed of the elevator car. U.S. Pat. Nos. 3,902,572 and 4,019,606 illustrate cam/switch, and optoelectronic arrangements, respectively, which may be used to detect when the elevator car is in the landing zone of a floor, and when it is substantially level with a floor. For purposes of example, it will be assumed that the elevator uses the cam/switch arrangement of U.S. Pat. No. 3,902,572.

Co-pending application Ser. No. 409,687, filed Aug. 19, 1982, entitled "Elevator System", is also incorporated into the Specification of the present application by reference, as it shows elevator leveling control which may be used to provide certain input signals required by the speed pattern generator of the present invention.

Figure 1:
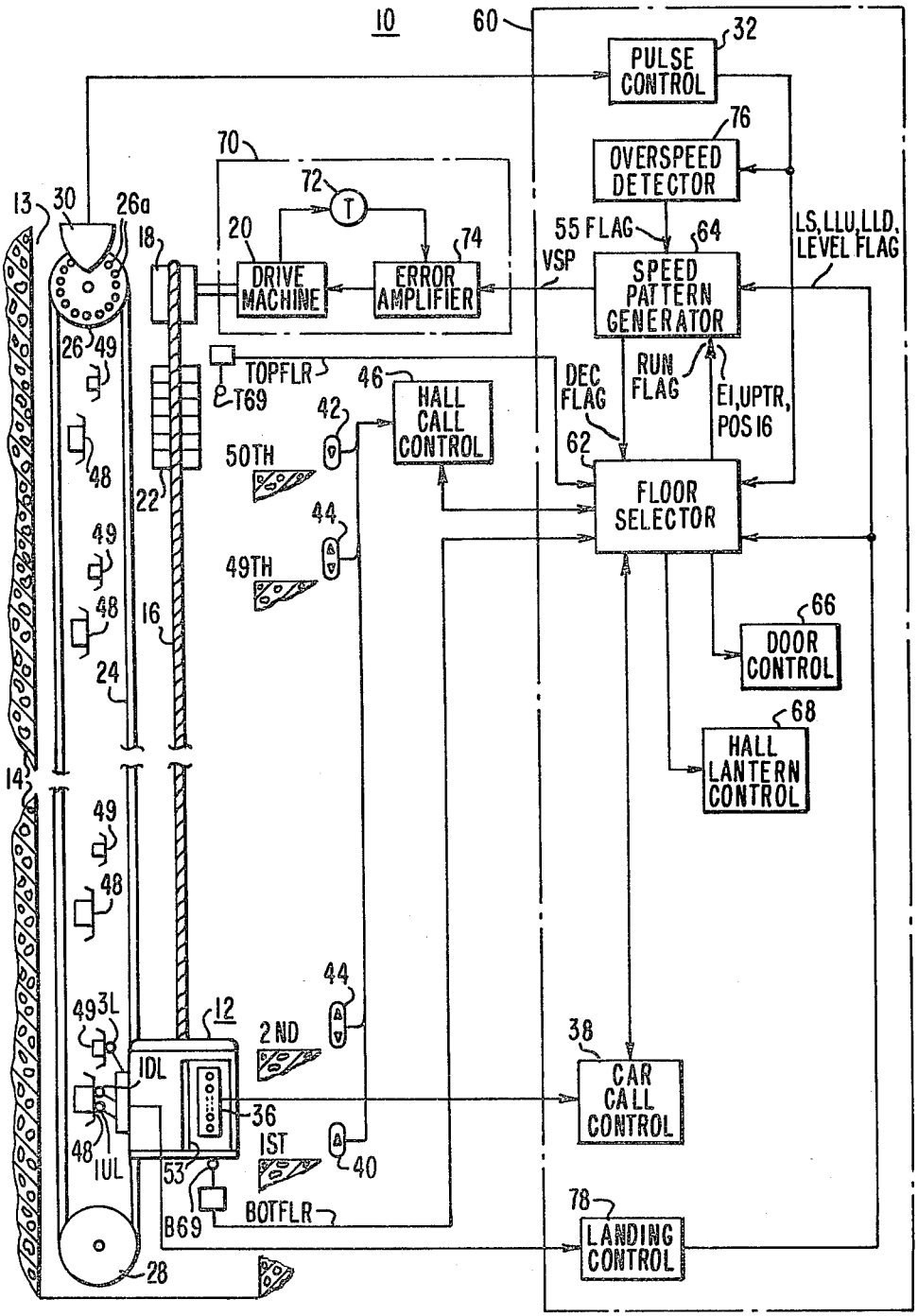
FIG. 1 is a schematic diagram of an elevator system which may utilize the teachings of the invention.

More specifically, FIG. 1 illustrates an elevator system 10 which may utilize the teachings of the invention. Elevator system 10 includes an elevator car 12, the movement of which is controlled by a car controller 60, which in turn may be controlled by a system processor (not shown), when the system is under group supervisory control. The car controller 60 includes a floor selector 62 and a speed pattern generator 64. The floor selector 62 is described in detail in incorporated U.S. Pat. No. 3,750,850. It is sufficient for the understanding of the present invention to state that the floor selector 62, in addition to providing signals for door control 66 and hall lantern control 68, provides signals RUN, E1 and UPTR for the speed pattern generator. The signal RUN is true when the floor selector 62 detects a need for elevator car 12 to make a run, and this signal will be referred to as the RUN flag. Signal E1 is true when the floor selector 62 detects that the AVP floor is the target floor. Signal UPTR is the travel direction signal prepared by the floor selector 62, with UPTR being a logic one for the up-travel direction, and a logic zero for the down-travel direction.

Car 12 is mounted in a hatchway 13 for movement relative to a structure 14 having a plurality of landings, such as 50, with only the 1st, 2nd, 49th and 50th floors or landings being shown, in order to simplify the drawing. The car 12 is supported by a plurality of wire ropes 16 which are reeved over a traction sheave 18 mounted on the shaft of a drive machine 20. The drive machine 20 may be an AC system having an AC drive motor, or a DC system having a DC drive motor, such as used in the Ward-Leonard drive system, or in a solid state drive system. The drive machine 20, along with its associated closed loop feedback control is referred to generally as drive machine control or motor control 70. Motor control 70, which is shown in detail in incorporated U.S. Pat. No. 4,277,835, includes a tachometer 72 and an error amplifier 74. The tachometer 72 provides a signal responsive to the actual rotational speed of the drive motor of the drive machine 20, and error amplifier 74 compares the actual speed signal with the desired speed signal represented by the speed pattern signal VSP provided by the speed pattern generator 64.

A counterweight 22 is connected to the other ends of the ropes 16. A governor rope 24, which is connected to the car 12, is reeved over a governor sheave 26 located above the highest point of travel of the car 12 in the hatchway 13, and under a pulley 28 located at the bottom of the hatchway. A pick-up 30 is disposed to detect movement of the elevator car 12 through the effect of circumferentially-spaced openings **26*a* in the governor sheave 26, or in a separate pulse wheel which is rotated in response to the rotation of the governor sheave. The openings 26*a* are spaced to proved a pulse for each standard increment of travel of the elevator car 12, such as a pulse for each 0.25 inch of car travel. Pick-up 30 may be of any suitable type, such as optical or magnetic. Pick-up 30 is connected to pulse control 32 which provides distance pulses for the floor selector 62. Distance pulses may be developed in any other suitable manner, such as by a pick-up disposed on the elevator car 12** which cooperates with a coded tape disposed in the hatchway, or other regularly spaced indicia in the hatchway.

The distance pulses may also be used by an overspeed detector 76. The pulse rate is an indication of car speed. A simple overspeed detector may be provided by a switch/low pass filter arrangement, such as the arrangement shown in FIG. 18 of incorporated U.S. Pat. No. 3,750,850. This arrangement provides an analog output having a magnitude proportional to pulse rate. The output of the filter may be connected to an input of a comparator. Another input of the comparator is connected to a reference. If the output of the filter exceeds the reference, the output of the comparator will switch from one logic level to the other, providing a true signal which is referred to an the 55 flag. The 55 flag is another input signal used by the speed pattern generator 64.

Car calls, as registered by pushbutton array 36 mounted in the car 12, are processed by car call control 38, and the resulting information is directed to the floor selector 62.

Hall calls, as registered by pushbuttons mounted in the hallways, such as the up pushbutton 40 located at the 1st floor, the down pushbutton 42 located at the 50th floor, and the up and down pushbuttons 44 located at the 2nd and other intermediate floors, are processed in hall call control 46. The resulting processed hall call information is directed to the floor selector 62.

The floor selector 62 tabulates the distance pulses from the pulse detector 32 in an up/down counter to develop information concerning the precise position of the car 12 in the hatchway 13, to the resolution of the standard increment. When the car 12 is level with the lowest floor the car position count, referred to as POS 16, is zero. The POS16 count when the car 12 is level with each floor is used as the address for the associated floor. The speed pattern generator 64 also uses the POS 16 count.

The floor selector 62, in addition to keeping track of the position of the car 12, also tabulates the calls for service for the car, and it provides signals for starting the elevator car on a run to serve calls for elevator service.

The floor selector 62, and also the speed pattern generator 64, as will be hereinafter described, develop an advanced floor position for the elevator car 12, referred to as the AVP floor, or simply as AVP. The advanced floor position AVP is the closest floor ahead of the elevator car 12 in its travel direction at which the car can stop according to a predetermined deceleration schedule. The floor at which the car 12 should stop, to serve a car call or a hall call, or simply to park, is referred to as the target floor. When the AVP of the car 12 reaches the target floor, the floor selector 62 provides a true signal E1, which is also used by the speed pattern generator 64. Floor selector 62 also controls the resetting of the car calls and hall calls when they have been serviced.

Accurate landing and leveling of the car 12 at each floor may be accomplished by leveling switches 1DL and 1UL mounted on the elevator car 12, which cooperate with leveling cams 48 at each floor, as described in incorporated U.S. Pat. No. 3,902,572. Accurate landing and leveling may also be accomplished by a hatch transducer system which utilizes inductor plates disposed at each landing and a transformer mounted on the elevator car 12, as described in incorporated U.S. Pat. No. 4,019,606. A switch 3L mounted on the car 12 and cams 49 mounted in the hoistway may be used to determine when the elevator car is a predetermined distance from a floor, such as ten inches. Alternatively, the optoelectronic arrangement of U.S. Pat. No. 4,019,606 may be used to provide such position signals.

As shown in incorporated application Ser. No. 409,687, switches 1UL, 1DL and 3L may be connected to control the operative state or condition of electromagnetic relays LU, LD and L2, respectively, shown generally as landing control 78.

When car 12 is within about ±0.25 inch of floor level, both switches 1UL and 1DL will be on a cam 48, and their associated relays LU and LD will both be deenergized. If the car 12 moves up or down from the level position, switch 1UL or switch 1DL will come off the cam and pick up relay LU or LD, respectively, to initiate up or down releveling. A zone of ±2 to 3 inches is provided about each floor level, in which at least one of the switches 1DL or 1UL is on a cam, which zone thus defines the releveling zone.

As described in the incorporated application, switch 3L may control relay L2 which starts a timer LT2 about ten inches from the target floor. The LT2 timer is set to a value which represents the normal time for the elevator car to move from the predetermined point, such as the ten inch point, to the leveling zone. When the LT2 timer times out, this fact may be used to initiate a leveling program, if the elevator car 12 is not within ±0.25 inch of floor level.

When car 12 needs releveling, the LT2 timer and switches 1UL and 1DL may also set a flip-flop, or other suitable memory, which, when set, provides a true flag LEVEL, which may be used by the speed pattern generator 64 to initiate a leveling speed pattern.

Figure 2:
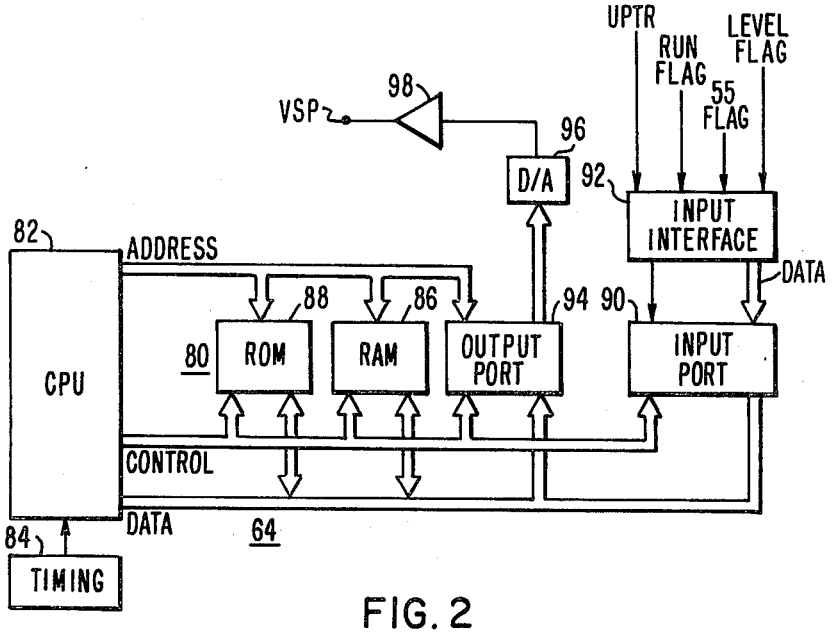
FIG. 2 is a schematic diagram of a microcomputer which may be used to implement the teachings of the invention.

The speed pattern generator 64 of the invention is preferably implemented by a digital computer, and more specifically by a microcomputer. FIG. 2 is a schematic diagram of a microcomputer arrangement 80 which may be used. As hereinbefore stated, all of the functions of the car controller 60 may be implemented by the single microcomputer 80, which simplifies the communication between the floor selector and speed pattern generator functions, as they may use a common random access memory (RAM). However, since the present invention relates to the speed pattern function, it simplifies the description to merely state what signals the speed pattern generator receives from other functions, and to refer to patents or patent applications for apparatus which can provide such signals.

More specifically, microcomputer 80 includes a central processing unit (CPU) 82, system timing 84, a random access memory (RAM) 86, a read-only memory (ROM) 88, an input port 90 for receiving signals from external functions via a suitable interface 92, an output port 94 to which the digital speed pattern signal is sent, a digital-to-analog (D/A) converter 96, such as Analog Devices 565, and an amplifier 98 which provides the analog speed pattern signal VSP. The microcomputer 80, for example, may be INTEL's iSBC80/24 TM single board computer. With this computer, the CPU would be INTEL's 8085A microprocessor, the timing function 84 would include INTEL's clock 8224, and the input and output ports would be onboard ports.

The actual car position POS16 may be maintained by a solid state, binary up/down counter, and/or the floor selector function may be provided by the microprocessor 80 shown in FIG. 2. If the latter, the microprocessor 80 may maintain a counter in RAM 86 for maintaining the car position, which count will be referred to as POS16.

Figure 3:
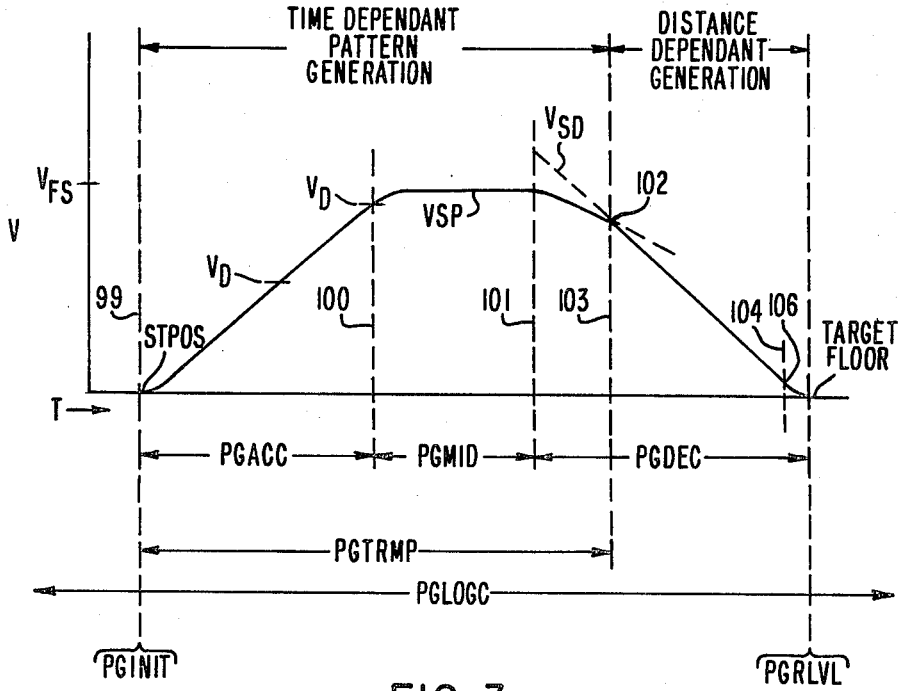
FIG. 3 is a graph which illustrates a speed pattern and the functional modules which are called by a supervisory or logic module to control various portions of the speed pattern.

A typical speed pattern VSP is shown in FIG. 3. It starts at STPOS, indicated by broken vertical line 99, which is the starting position of the elevator car 12 in terms of the count POS16. The speed pattern, which is initially a time based pattern, then increases in a jerk limited manner until the AVP floor of the car 12 reaches the level of the target floor, or the acceleration rate reaches a predetermined maximum value, whichever comes first. If constant acceleration is reached before the car's AVP reaches the target floor, the pattern VSP will increase with a predetermined constant acceleration a, such as 3.75 ft/sec.$^2$ until the car's AVP reaches a target floor, or the speed pattern approaches a predetermined rated value $V_{FS}$, whichever comes first. If the rated value $V_{FS}$ is approached before the car's AVP reaches the target floor, the acceleration is reduced to zero, starting at broken vertical line 100, in a jerk limited manner, to cause the pattern to smoothly change from the linearly increasing speed value to a constant speed value $V_{FS}$.

The speed pattern VSP continues at the constant magnitude $V_{FS}$ until the car's AVP reaches the target floor, at which point, indicated by broken vertical line 101, a distance dependent speed pattern $V_{SD}$ is generated simultaneously with the time based pattern VSP. Pattern $V_{SD}$ has an acceleration rate of $-a$, i.e., deceleration, and its starts as shown by the broken line showing in the figure. The time based pattern is changed in a jerk limited manner from zero acceleration to $-0.75$ a, to cause it to quickly cross pattern $V_{SD}$, as disclosed in co-pending application Ser. No. 210,439, filed Nov. 25, 1980, entitled "Elevator System", now U.S. Pat. No. 4,373,612. When they cross at this high speed transfer point 102, through which broken vertical line 103 passes, pattern $V_{SD}$ is substituted for the time based pattern, and thus pattern $V_{SD}$ becomes the speed pattern VSP which is output to the error amplifier 74. The speed pattern reduces at the constant rate $-a$ until car 12 reaches a predetermined distance from the target floor, such as ten inches, represented by broken vertical line 104. The speed pattern from the ten inch point to the floor level may be provided by a seperated analog signal generator, which would be substituted for pattern VSP at the low speed transfer point 106. Such an analog generator may be provided by the hereinbefore mentioned hatch transducer. Or, as will be hereinafter described, the car position count POS 16 from the ten inch point to floor level may be used to address a ROM which will output a digital pattern, providing a different value for each 0.25 inch of car movement. This digital pattern would be sent to the D/A converter 96.

According to the teachings of the invention, the speed pattern generator 64 includes a plurality of function modules, each of which controls a specific portion of the speed pattern VSP. The function modules are under the control of a supervisory or logic module referred to as module PGLOGC. As illustrated in FIG. 3, module PGLOGC is periodically run throughout the entire run of the elevator car 12, as well as when the elevator car 12 is standing at a floor. When the floor selector 62 determines that a run should be made and sets the flag RUN, module PGLOGC calls a function module PGINIT. This module initiates the speed pattern and enables a module PGTRMP. Module PGTRMP provides a time ramp function, and its output provides the time dependant portion of the speed pattern VSP. Module PGINIT calculates a first decision speed $V_D$, as will be hereinafter explained in detail, and it sets a flag ACCEL. When module PGLOGC runs again, it will call a module PGACC, because of the flag ACCEL being set. Module PGACC sets the parameters for the time ramp generator module, and it remains in control of these parameters until it sets the desired acceleration to zero. This occurs when the car's AVP reaches the target floor, or when the pattern magnitude approaches rated speed $V_{FS}$. Module PGACC then calculates the car slowdown distance SLDN, and it sets a flag MIDRN. Module PGLOGC then calls a module PGMID the next time it runs, in response to flag MIDRN being set. Module PGMID uses the distance SLDN to determine when the car 12 is located the distance SLDN from the AVP floor. When it detects that the car has reached the distance SLDN from the AVP floor, and the AVP floor is the target floor, it sets the desired acceleration for the module PGTRMP to $-0.75$a, and it sets a flag DECEL. The next time module PGLOGC runs, it will call a module PGDEC as a result of flag DECEL being set. Module PGDEC calculates the digital pattern $V_{SD}$ and it detects when the time based portion of the pattern crosses the distance based portion $V_{SD}$. At the crossing point 102, module PGDEC disables the module PGTRMP, and it substitutes the distance based pattern for the time based pattern. At the ten inch point from the target floor, module PGDEC may continue to provide the landing speed pattern, or it may transfer control to an auxiliary pattern generator. If releveling is required, module PGLOGC calls a module PGRLVL, which provides the releveling speed pattern. Another module PGSFLR is also callable by module PGLOGC, as will be hereinafter explained, when the distance between the starting position of the elevator car and the target floor is less than a predetermined value, such as four feet. Module PGSFLR provides the speed pattern for this "short run".

Figure 4:
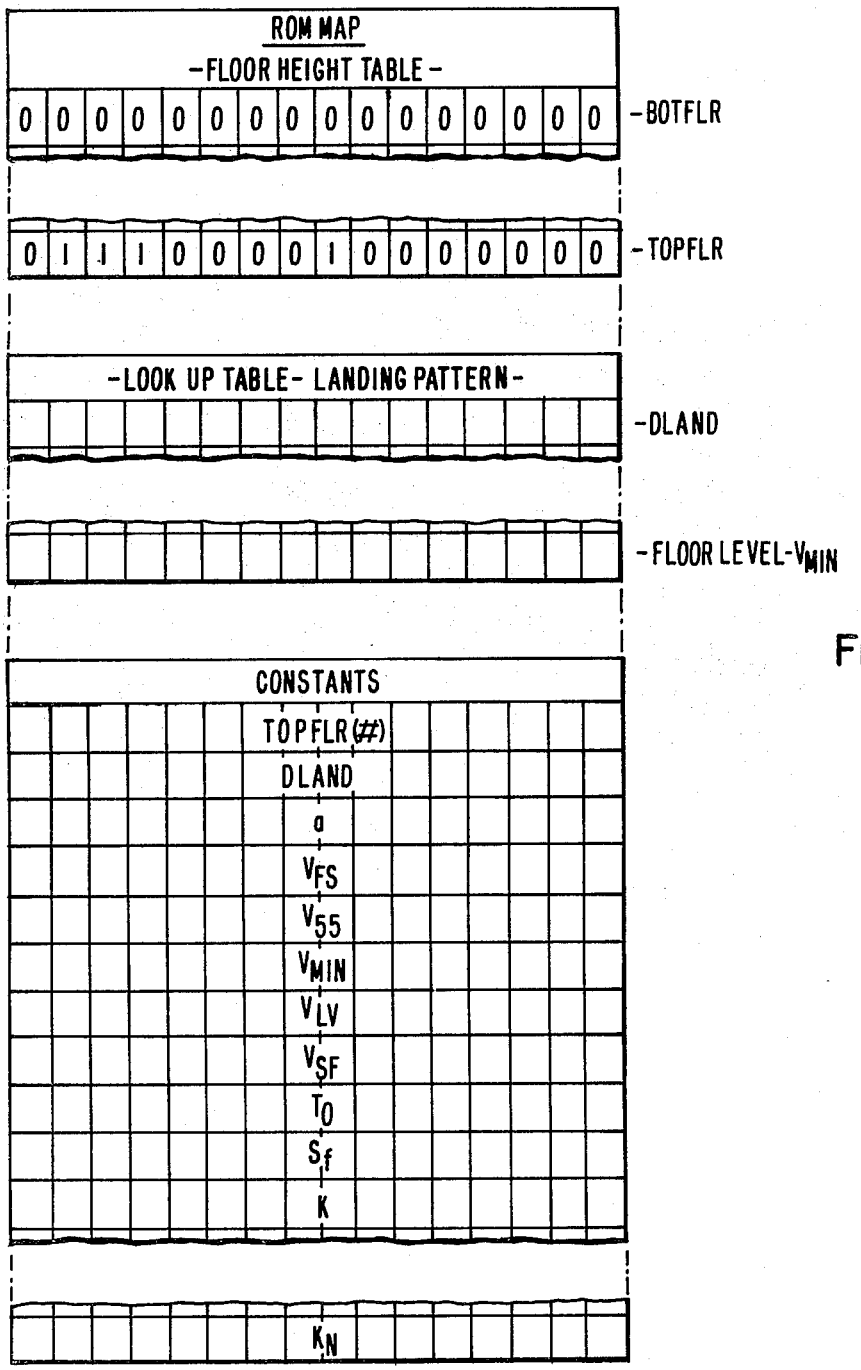
FIG. 4 is a ROM map which sets forth certain tables and constants stored in ROM which will be referred to during the description of a preferred embodiment of the invention.

Each floor of the building has a binary address corresponding to its height or distance from the lowest floor of the building, with the binary address being in the terms of the standard increment. The first floor address may be all zeros. If the 50th floor is 600 feet above the first floor, for example, its binary address, when a pulse is generated for each 0.25 inch of car travel would be 0111 0000 1000 0000, the binary representation for 28,800. The binary address for each floor is maintained in a floor height table stored in ROM 88, with FIG. 4 being a ROM map which sets forth a suitable format for the floor address table. Also, as shown in the ROM map of FIG. 4, ROM 88 may include a look-up table for obtaining the landing pattern, and ROM 88 will also include all of the constants used by the function modules.

Figure 5:
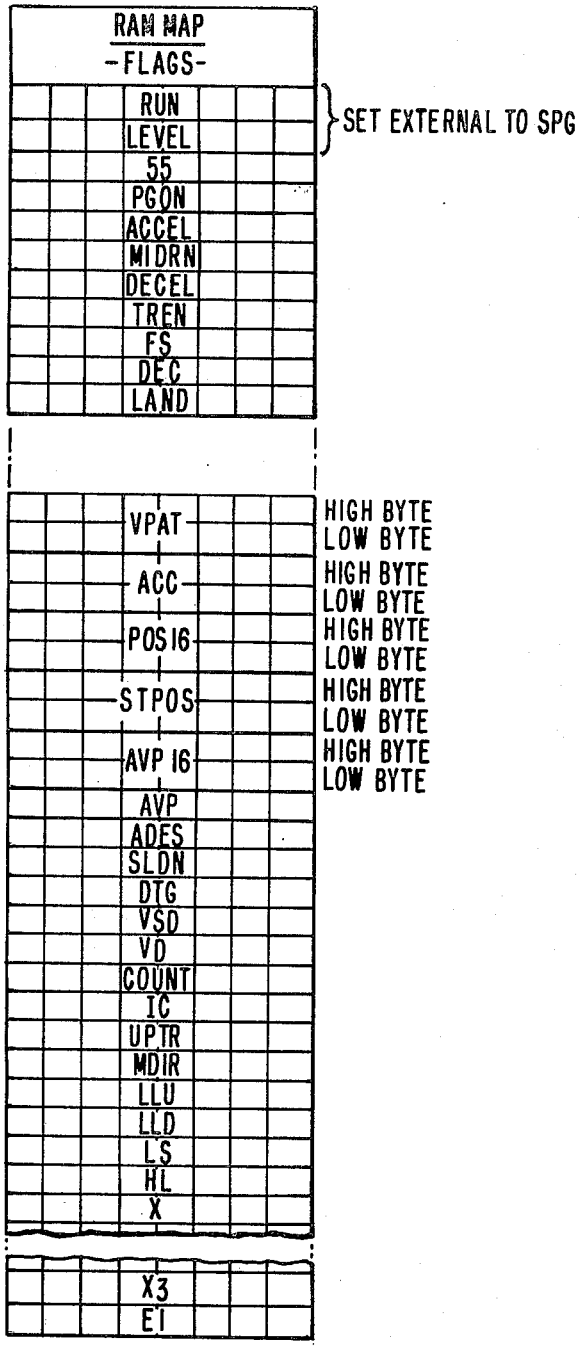
FIG. 5 is a RAM map which sets forth certain flags and program variables stored in RAM in a preferred embodiment of the invention.

FIG. 5 is a RAM map which sets forth suitable formats for certain data which may be stored in RAM 86, including the flags RUN, LEVEL and 55, which flags are set externally to the speed pattern generator, the flags which are set and reset by the pattern generator modules, and a plurality of other signals and program variables which will be referred to when the various modules are described in detail.

Figure 6:
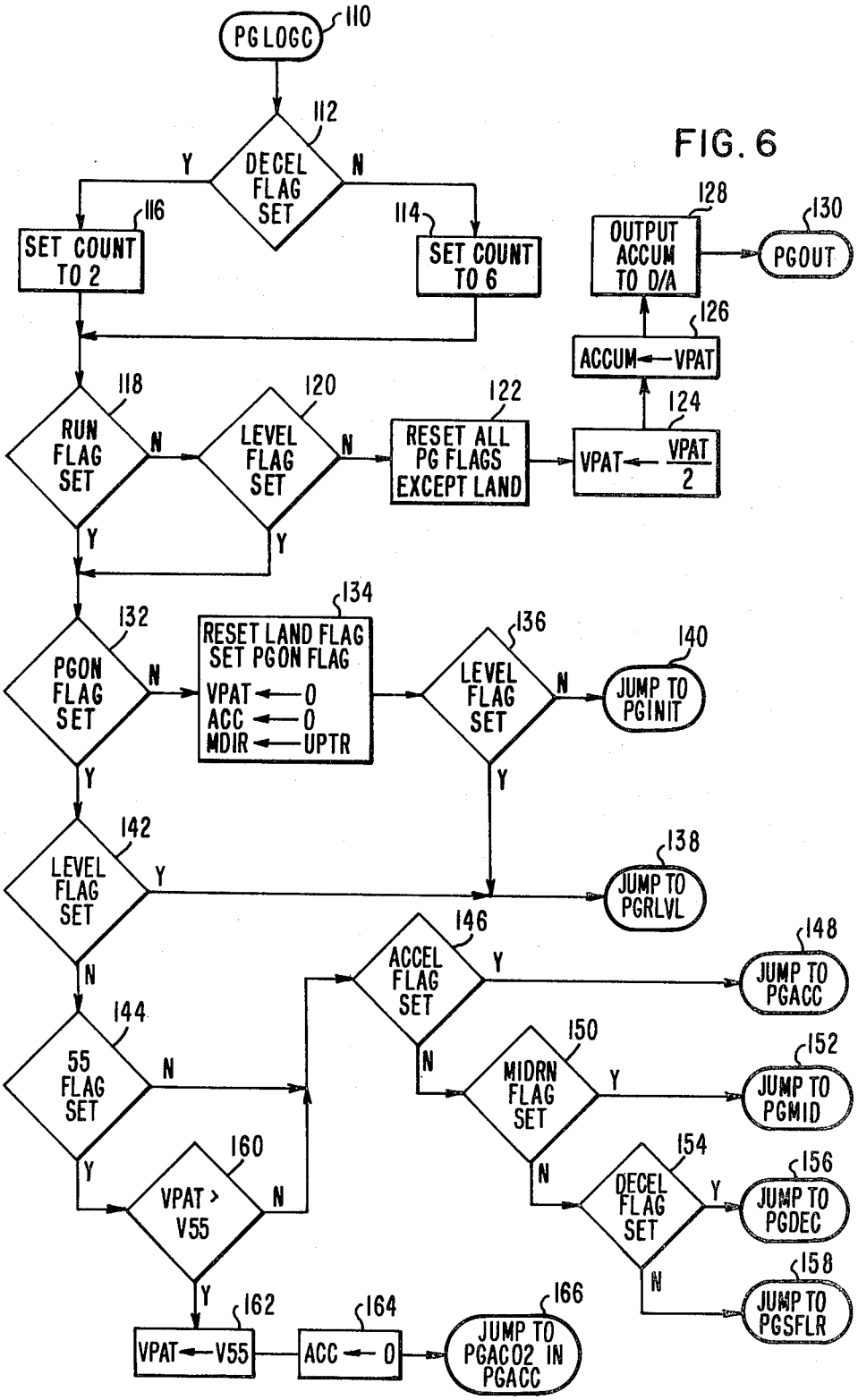
FIG. 6 is a flow chart of a supervisory control or logic module PGLOGC which runs periodically to interpret commands made to the pattern generator, to determine the current status of the pattern generator, and to transfer control to a function module which handles the function required of the pattern generator at any given time.

FIG. 6 is a detailed flow chart of the supervisory or logic module PGLOGC which is sotred in ROM 88 and periodically run to: (a) interpret commands to the speed pattern generator 64, (b) determine the current status of the pattern generator, and (c) to transfer control to the function module which handles the specific function required of the pattern generator at any given time.

The time ramp generator module PGTRMP is run in response to time interrupts, such as an interrupt every 4.167 MS, or 240 times per second. Program PGLOGC need not run that often during the time based phase of the speed pattern, as it only provides parameters for PGTRMP, and is not responsible for producing the pattern per se. Thus, the program for module PGTRMP may count the interrupts and compare the interrupt count IC with a value stored at a location COUNT in the RAM map of FIG. 5. When the interrupt count IC reaches the value of COUNT, such as six, then module PGLOGC may be run. When the distance based portion of the speed pattern is operative, module PGLOGC calls the module PGDEC to produce actual points on the speed pattern curve. Thus, when the pattern reaches this phase, module PGLOGC should be run more often in order to produce a pattern having the desired precision. Accordingly, module PGLOGC may be run every second interrupt during the distance based phase of the speed pattern, for example. This arrangement is implemented at the start of program PGLOGC, which is entered at a starting address referenced 110. Steps 112, 114 and 116 then set the value for COUNT according to whether or not the distance based pattern phase has been reached. If the flag DECEL is not set, the speed pattern is in the time based phase. If flag DECEL is set, the distance based pattern is being calculated. Thus, step 112 checks flag DECEL, setting COUNT to six in step 114 if flag DECEL is not set, and setting COUNT to two in step 116 if it is set.

Step 118 then checks the flag RUN in RAM 86 to see if the floor selector 62 is requesting that the elevator car 12 begin a run. If RUN is not set, step 120 checks the flag LEVEL to see if the landing control 78 is requesting releveling. If flag LEVEL is not set, step 122 resets all flags except LAND, which maintains stretch-of-rope releveling active, and any speed pattern value is reduced to zero in steps. The digital pattern value is referred to as VPAT, and it is stored in RAM 86 as a two byte value, with only the higher byte being significant as far as the value of the speed pattern is concerned. Any speed pattern value is reduced to zero in steps by program steps 124, 126 and 128, as the module PGLOGC is run repeatedly, even when the speed pattern is not being generated, in order to detect commands addressed to the speed pattern generator. Step 124 divides VPAT by two, the new value of VPAT is output to the accumulator of a microcomputer in step 126, step 128 outputs the value in the accumulator to the D/A converter 96 via the output port 94, and the program returns to an interrupted program, or to a priority executive, at exit 130.

Six interrupts later, step 124 will again reduce VPAT by two, and this will continue, with VPAT being rapidly reduced to zero.

Figure 17:
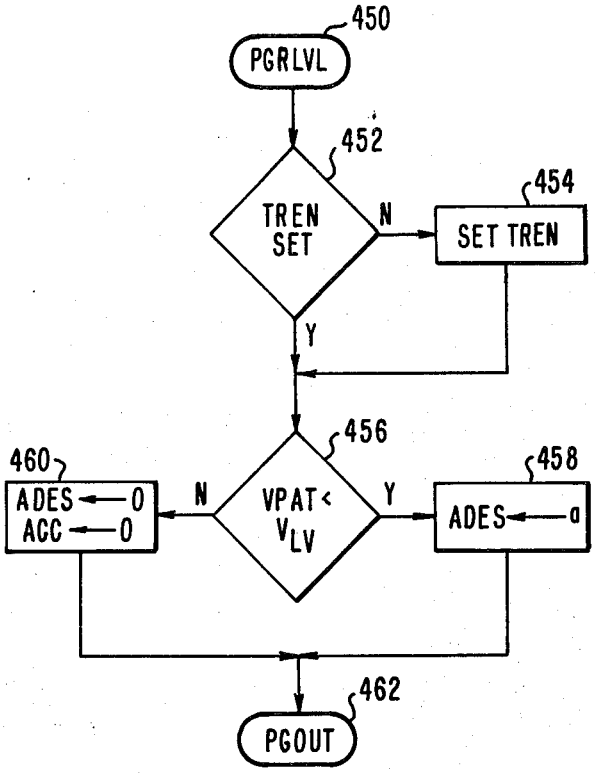
FIG. 17 is a flow chart of a function module PGRLVL which is called by module PGLOGC to develop a speed pattern when releveling of the elevator car is required.
Figure 18:
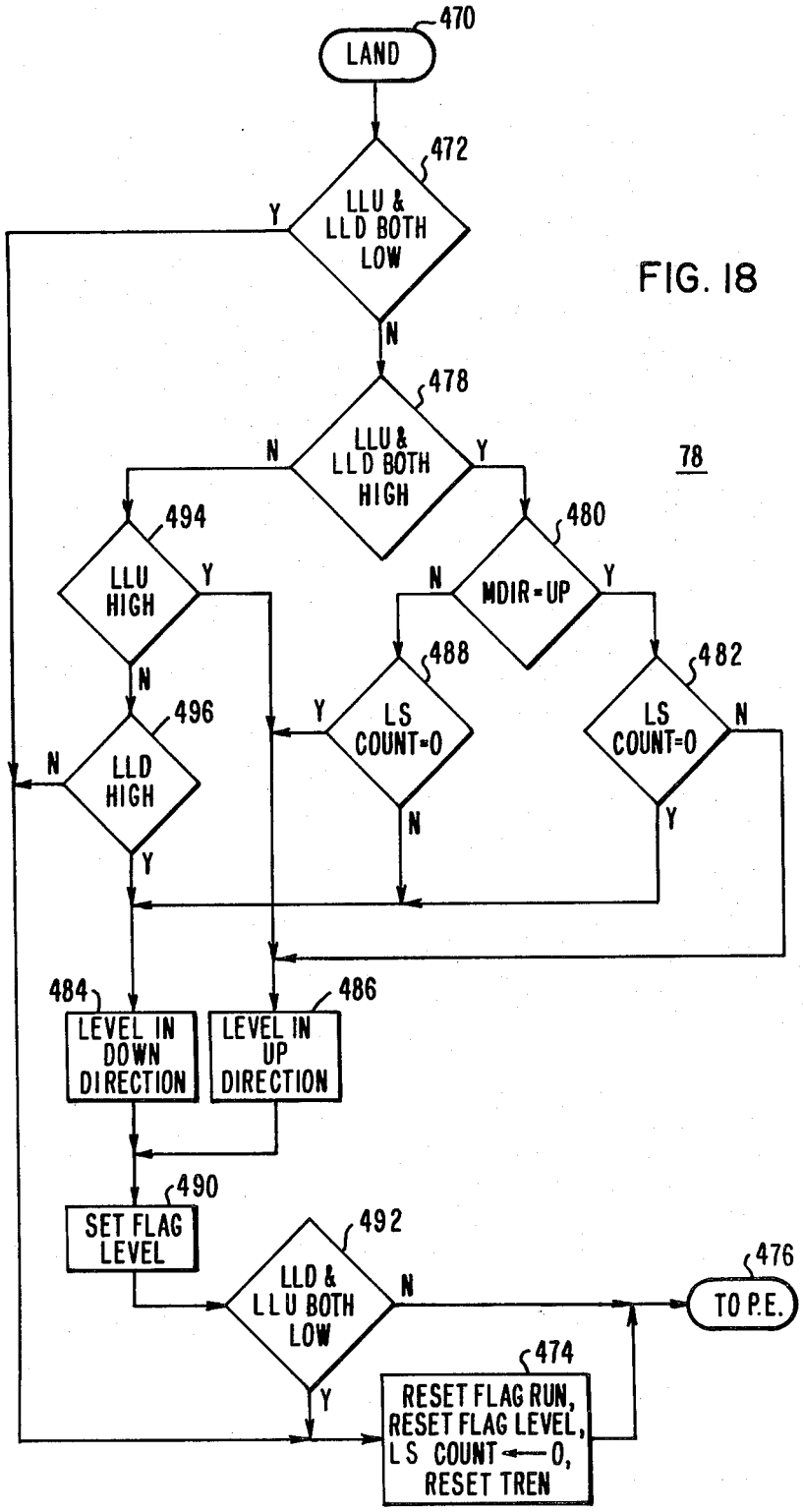
FIG. 18 is a flow chart of a program LAND, which program is part of the car controller, but not part of the speed pattern generator, with the program LAND being called to establish a releveling direction, and also to set a flag which commands module PGLOGC to transfer control to module PGRLVL.

If the elevator car 12, while sitting at a floor needs releveling, the landing control 78 shown in detail in FIG. 18, will set the flag LEVEL. Thus, step 120 will find the flag LEVEL set, and the program checks flag PGON in step 132. Flag PGON is used to make sure that module PGINIT is run once at the start of an actual run of the elevator car. Step 132 will not find flag PGON set, and step 134 resets flag LAND, it sets the digital value of the pattern VPAT to zero, it sets the value of the actual acceleration which is applied to the pattern to zero, which is referred to as ACC, and it sets a variable MDIR in RAM 86 to indicate the present value of the signal UPTR provided by the floor selector 62. UPTR is a logic one when the floor selector selects the up travel direction for a run, and a logic zero when it selects the down travel direction for a run. Step 136 will find the flag LEVEL set, and module PGLOGC transfers control to module PGRLVL by jumping to its starting address at 138. Module PGRLVL, which provides the releveling pattern via the time ramp module PGTRMP, is shown in detail in FIG. 17, and will be hereinafter described. Six interrupts latter, step 132 will find flag PGON set, and step 142 will find the flag LEVEL set. Step 142 then proceeds to step 138. When the car is again level, the flag LEVEL will be reset by landing control 78, and module PGLOGC will quickly reduce the leveling pattern to zero via the path which includes steps 118, 120, 122, 124, 126 and 128.

Figure 8:
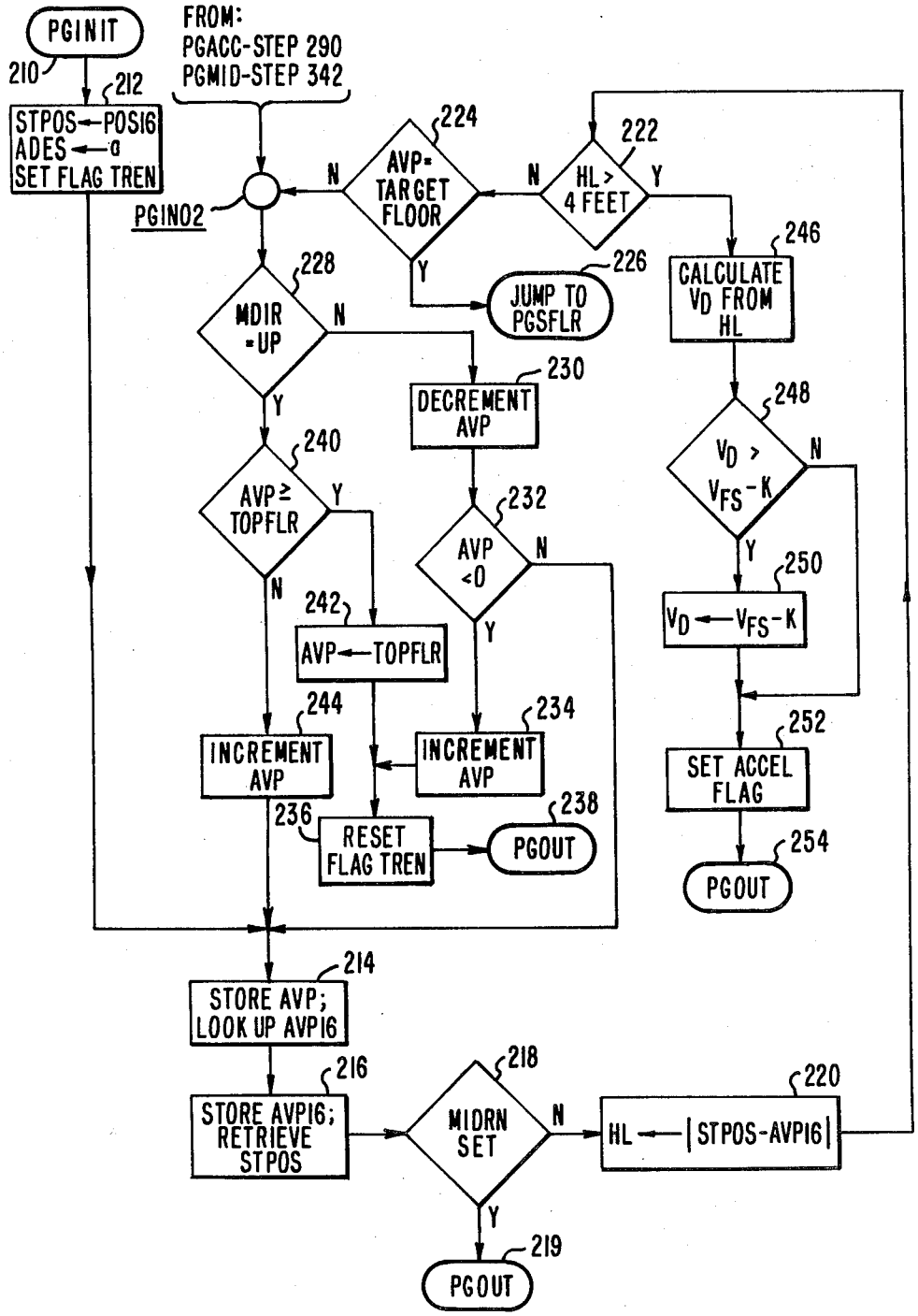
FIG. 8 is a flow chart of a program module PGINIT which is called at the start of a run of the elevator car to initiate the speed pattern, and which is also utilized during certain portions of the run to update the AVP floor and to calculate decision speeds $V_D$.

If an actual run is being requested by floor selector 62, step 118 will find the flag RUN set, step 132 will not find flag PGON set, and the program follows steps 134 and 136 to step 140, which transfers control to program module PGINIT shown in FIG. 8. Module PGINIT will initiate the speed pattern as will be hereinafter described, and six interrupts latter, step 132 will flag PGON set and thus will not transfer control to module PGINIT.

Step 132 then proceeds to step 142, which will not find flag LEVEL set, and step 144 checks flag 55 controlled by the overspeed detector 76. Since this is the very start of a run, step 144 will not find flag 55 set and step 146 checks to see if the flag ACCEL has been set. Module PGINIT sets flag ACCEL when it runs at the start of the initiation of the speed pattern, and thus step 146 transfers control to module PGACC at step 148.

When module PGACC no longer has a need to run, it resets flag ACCEL and it sets flag MIDRN. When this happens, step 146 will now go to step 150 which checks flag MIDRN. Since it is now set, module PGLOGC transfers control to module PGMID in step 152. When program PGMID no longer has a need to run, it will reset flag MIDRN and it will set flag DECEL. When this happens, step 150 will advance to step 154, and step 154 will advance to step 156 which transfers control of the speed pattern generator to module PGDEC.

Figure 19:
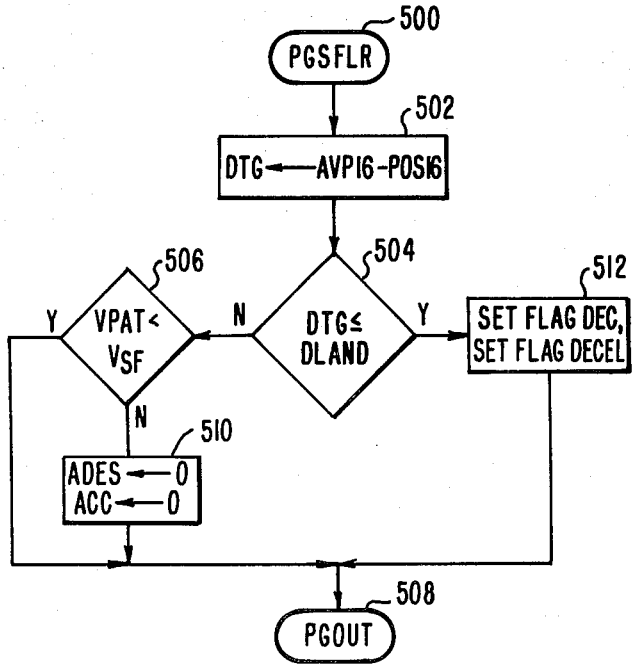
FIG. 19 is a flow chart of a module PGSFLR which is called by module PGLOGC to provide a short floor speed $V_{SF}$ for controlling the time ramp module PGTRMP.

If program PGINIT in step 140 finds that a short run is to be made, it will jump to module PGSFLR shown in FIG. 19. Flags ACCEL, MIDRN, and DECEL will not be set. Thus, on the next running of PGLOGC, step 132 will find flag PGON set and proceed to step 158 via steps 142, 144, 146, 150 and 154. Step 158 returns to the module PGSFLR.

The overspeed detector 76 is set to a first level of overspeed detection. If it detects the car speed exceeding this first level, it sets flag 55 and module PGLOGC will detect this in step 144. The PGLOGC program then checks to see if VPAT, the digital value of the speed pattern, exceeds $V_{55}$, the digital value to which the pattern should be clamped when flag 55 is set, which value is stored in ROM 88. This value may typically be about 85% of contract speed. Depending upon the cause of overspeed, this step may or may not assist in reducing the overspeed condition, but the pattern generator is not concerned beyond performing the clamping function. If VPAT does not exceed $V_{55}$, the overspeed is not caused by the speed pattern generator, and thus the speed pattern generator can do nothing about the overspeed condition. Other parts of the elevator system will take protective action, and the PGLOGC program goes to step 146 to proceed in its normal manner.

More specifically, if step 160 detects that VPAT exceeds $V_{55}$, the overspeed condition may have been caused by the speed pattern generator, and it immediately corrects the overspeed condition by setting VPAT to $V_{55}$ in step 162, and by setting the actual acceleration ACC, which is the actual rate of change of the speed pattern, to zero in step 164. The actual rate of change of the speed pattern is indicated by the low byte of ACC in RAM 86. The program jumps to location PGACO2 in module PGACC (FIG. 11) which, as will be hereinafter described, causes control of the speed pattern to be transferred to module PGMID.

Figure 7:
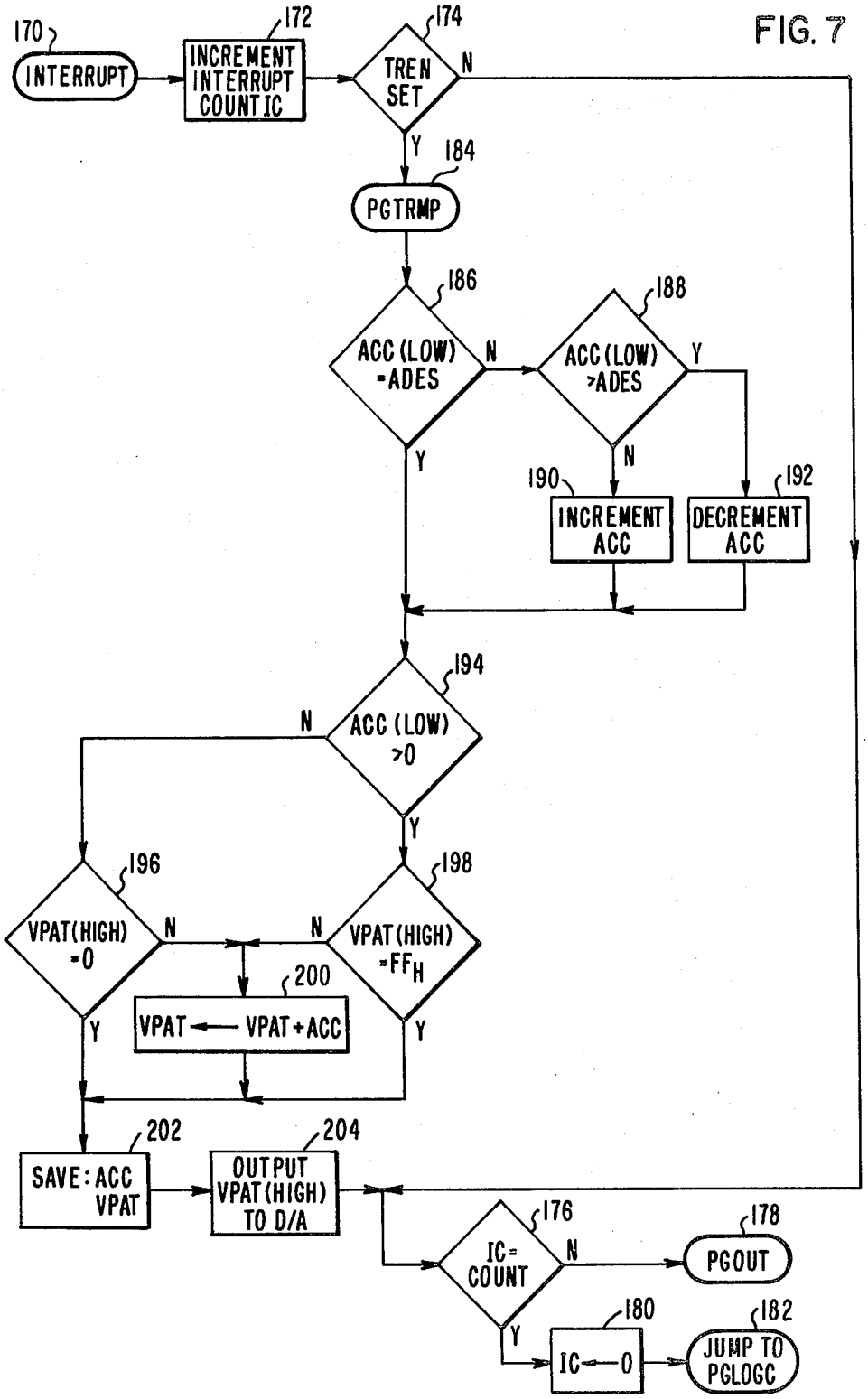
FIG. 7 is a flow chart of an interrupt driven time ramp generator module PGTRMP which is enabled and disabled by certain of the function modules which are called by the supervisory control module PGLOGC when the time based portion of the speed pattern is being generated.

As hereinbefore stated, the time ramp generator function PGTRMP is interrupt driven by time interrupts, which may occur every 4.167 MS, for example. When a time interrupt is generated, the microcomputer 80 stops the task it is processing, it stores its status for later return, and it is vectored to a predetermined address in ROM 88, indicated at 170 in FIG. 7. Step 172 increments the interrupt count IC stored in RAM 86 and step 174 checks to see if a function module of the speed pattern generator has enabled the time ramp function by checking flag TREN in RAM 86. If flag TREN is not set, the program advances to step 176 which compares the count IC with COUNT. If the count IC is not equal to the count value stored in COUNT, module PGLOGC need not be run, and the program returns to the interrupted program at 178. If step 176 finds the count IC equal to the value of COUNT, step 180 sets the count IC to zero, and step 182 may jump to program PGLOGC, or it will at least set a flag for the priority executive in order to indicate the need for module PGLOGC to run.

If step 174 finds flag TREN set, the time ramp generator function has been enabled by module PGINIT, or by module PGRLVL, and the program advances to the starting address of module PGTRMP at 184. Step 186 checks to see if the actual acceleration or rate of change of the speed pattern, indicated by the low byte of ACC in RAM 86, is equal to the desired value ADES. The desired acceleration ADES is a parameter controlled by one or more of the functional program modules. If the actual acceleration ACC is not equal to the desired acceleration ADES, step 188 checks to see if ACC is greater than ADES. If it is not, it is less than ADES and the actual acceleration should be increased. Thus, step 190 increments ACC. If step 188 finds ACC exceeds ADES, step 192 decrements ACC.

The time ramp module PGTRMP does not know when the speed pattern reaches its rated value. This intelligence occurs in module PGACC. Module PGTRMP, however, does check to make sure it is between predetermined limits. Steps 194, 196 and 198 perform this function. Step 194 checks to see if ACC is greater than zero. If it is not greater than zero, step 196 checks to see if the high byte of VPAT is zero (the lower limit). If ACC is not greater than zero, and VPAT is zero, the pattern should not be modified.

If step 194 finds ACC is greater than zero, step 198 checks the upper limit. The upper limit is selected such that it is represented by the high byte of VPAT being all ones, i.e., $FF_H$. If ACC is greater than zero, and the high byte of VPAT has reached the upper limit, the pattern should not be modified.

If ACC is not greater than zero (step 194) and VPAT is above its lower limit of zero (step 196) step 196 advances to step 200 which adds the two byte value of ACC to the two byte value of VPAT. If ACC is zero, the pattern, of course, should not be changed, and step 200, by adding zero to VPAT, produces no change in VPAT.

If step 194 finds ACC greater than zero, and step 198 finds VPAT is below the upper limit, step 198 advances to step 200. Since ACC is not zero, step 200 will now change the value of the pattern VPAT.

Step 202 saves the value of ACC and VPAT, and step 204 outputs the present value of VPAT (high byte) to the D/A converter 96.

Module PGTRMP produces the time based speed pattern in a jerk and acceleration limited manner by integrating jerk to provide acceleration, and by integrating acceleration to provide the digital speed pattern. The jerk increment selected for integration is "one", and it will be added to ACC at the rate of 240 times per second by step 190. The two byte value for ACC is added to the two byte value for VPAT.

More specifically, ACC is a 16 bit signed integer. The high byte conveys no new information, but is necessary for correct addition of ACC to the 16 bit unsigned (always positive) integer VPAT. As will be hereinafter explained, scaling for the low byte of ACC (ALOW) is selected as:

$$128 \text{ bits} = 4 \text{ ft./sec.}^2$$

Thus, maximum positive acceleration would appear as 0000 0000 0111 1111 for ACC, which is equivalent to +127 decimal, or +3.97 ft./sec.$^2$. The MSB of ACC is the sign bit. The low byte ALOW would thus be 0111 1111, with the MSB being the sign bit. Maximum negative acceleration (deceleration) would appear as 1111

1111 1000 0000, which is equivalent to −120 decimal or −4 ft./sec.$^2$. The low byte ALOW would be 1000 0000. Again, the MSB of ACC and ALOW is the sign bit.

The high byte of ACC is either all 1's or all 0's, following the sign bit of the 8-bit value ALOW. Thus, ACC may be said to be an 8-bit signed integer, "sign extended" to 16 bits for the purpose of addition to another 16-bit integer. Since ACC has only 8 meaningful bits, the decimal value of ACC can only range from −128 to +127.

The scaling referred to above is explained as follows by using a practical example:

By Choice:

(1) ACC−128 bits=4 ft./sec.$^2$ (thus 1 bit=0.03125 ft./sec.$^2$)

(2) Incrementing Value=1 bit (The rate of change of acceleration or jerk increment selected for integration)

(3) Incrementing Rate=240/sec.

Jerk Limit:

Adding 1 to the value of acceleration (ACC) at the rate of 240/sec. establishes the jerk limit as follows:

$$\text{Jerk}_{(max)} = \left(\frac{240}{\text{sec}}\right)(1\text{ bit})\left(\frac{.03125\text{ ft./sec.}^2}{\text{bit}}\right) = 7.5\text{ ft./sec.}^3$$

Velocity Limit $$\Delta V = a \cdot \Delta T$$

$$\text{therefore: } VPAT\left(\frac{\text{ft./sec.}}{\text{bit}}\right) = \left(\frac{.03125\text{ ft./sec.}^2}{\text{bit}}\right)\left(\frac{1}{240}\text{ sec.}\right)$$

$$VPAT = \frac{.00013021\text{ ft./sec.}}{\text{bit}}$$

Since bit position 9 of VPAT has a value of 256, each bit added to the high byte VPATH is equal to:

$$VPATH = 256 \times VPAT = \frac{.03333\text{ ft./sec.}}{Bit} = \frac{2\text{ ft./min.}}{\text{Bit}}$$

Using only the high byte of VPAT for information, which is unsigned, i.e., always positive, provides the maximum possible speed of:

$$V_{max} = 255\left(\frac{2\text{ ft./min.}}{\text{Bit}}\right) = 510\text{ ft./min.}$$

Therefore, the elevator system has a nominal maximum speed rating of 500 ft./min.

Module PGINIT, shown in detail in FIG. 8, is called by module PGLOGC to start the speed pattern. A portion of PGINIT is also used by modules PGACC and PGMID. When module PGINIT is called by PGLOGC, PGINIT is entered at 210 and step 212 looks up the present location of the elevator car in RAM 86, with its present location being indicated at POS16. Step 212 stores the value of POS16 in RAM 86 at a location STPOS. The location STPOS thus records the position of the elevator car at the start of the run. Step 212 also enables the time ramp generator module PGTRMP by setting flag TREN, and it requests rated acceleration by setting the desired acceleration ADES equal to a. On this initial pass through PGINIT, the advanced car position AVP is not automatically incremented, in order to take care of the occurrance where the car may be starting between floors for some reason, such as a return following an emergency stop or power failure. In this event, the AVP floor and target floor may be the same. For example, the AVP floor may be set by an emergency stop recovery module, such as set forth in co-pending application Ser. No. 370,021, filed Apr. 20, 1982, entitled "Elevator System". Step 214 stores the AVP and looks up its address in the floor height table in ROM 88. Step 216 stores the address of the AVP floor in RAM 86 at location AVP 16, and the starting position of the elevator car, STPOS, is retrieved. Step 218 checks to see if flag MIDRN is set. Since it will not be set at this time, step 218 proceeds to step 220 which determines the distance between the AVP floor and the starting position of the elevator car, and it stores it in RAM 86 at location HL. Thus, HL is the distance the elevator car will travel from its starting position to its advanced floor position AVP. Step 222 checks to see if HL is greater than four feet. If HL is not greater than four feet, the car may be starting between floors, or it may be a short run, such as between floors at the front and rear doors of the elevator car. Step 224 checks to see if the AVP floor is the target floor. The floor selector 62 will provide a true signal E1 when the AVP floor is the target floor. If the AVP floor is the target floor, the program jumps to module PGSFLR shown in FIG. 19, to provide a short run speed pattern having a maximum value of $V_{SF}$.

If step 224 finds the AVP floor is not the target floor, step 224 advances to program point PGINO2 to begin the update procedure of the AVP floor, and to determine a new travel distance HL. This is also the point entered by modules PGACC and PGMID when these modules detect a need to update the AVP floor. Step 228 checks the memorized travel direction MDIR. If the car travel direction is down, step 230 decrements AVP. Step 232 checks to see if the AVP was already at the lowest floor prior to the decrementing step. If it was, step 234 returns the AVP to the lowest floor by incrementing AVP. Since the car will have been found to be at the lowest floor with a down travel direction, the run has been completed. Step 236 resets flag TREN to disable the module PGTRMP, and the program exits at point 238. If step 232 finds that the AVP was not already at the lowest floor, it advances to step 214.

If step 228 finds the car travel direction to be up, step 240 checks to if the AVP is equal to or greater than the top floor TOPFLR. If it is, step 242 sets AVP equal to the number of the TOPFLR, and it advances to step 236. If step 240 finds the AVP is not at the top floor, step 244 increments AVP and advances to step 214.

Thus, when step 222 is encountered with an HL value greater than four feet, the AVP floor will be correct and a normal run can be made. Step 246 calculates a decision speed $V_D$ using the travel distance HL from the starting position of the car to the AVP floor. Step 246 calls the subroutine shown in FIG. 10 to make the calculation. The decision speed $V_D$ is an important aspect of the invention. The decision speed $V_D$ is that speed to which the pattern can accelerate to before a decision need be made as to whether or not to continue to accelerate the pattern. The calculation $V_D$ is only made each time the AVP floor changes, and thus it places very little burden on the microcomputer.

Step 248 makes sure that the calculated decision speed $V_D$ does not exceed the maximum speed to which the pattern is accelerated to before flaring smoothly into its rated speed value. This speed is the full or rated speed $V_{FS}$ minus a predetermined constant K. If step 248 finds $V_D$ exceeds $V_{FS}-K$, step 250 sets $V_D$ equal to $V_{FS}-K$. If step 248 finds $V_D$ does not exceed $V_{FS}-K$, it proceeds to step 252, as does step 250, which sets the flag ACCEL so module PGLOGC will call the acceleration module PGACC the next time it runs. The program exits at 254.

Figure 9:
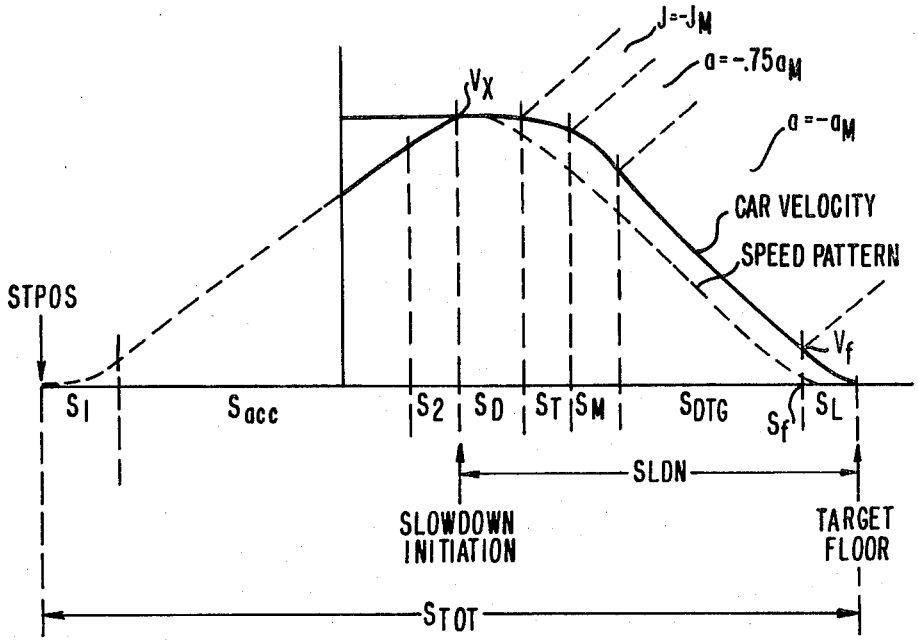
FIG. 9 is a graph which illustrates the travel distances associated with the various segments of a run of an elevator car, which graph is useful in understanding the derivation of certain calculations, including the calculation of the decision speed $V_D$ which is calculated in module PGINIT, and also in the calculation of the slowdown distance SLDN, which is calculated in module PGACC.

FIG. 9 is a graph which sets forth the various distances the elevator car travels during different portions of the speed pattern. $S_1$ and $S_2$ are the distances traveled as acceleration is increased from zero to a, and as acceleration is reduced from a to zero, respectively. $S_{acc}$ is the distance traveled during constant acceleration. $S_D$ is the distance traveled during a delay period following slowdown initiation up to the point where the pattern starts to change. $S_T$ is the distance traveled during "turn around", i.e. from "a" being equal to zero to the point where a is equal to −0.75a. $S_M$ is the distance traveled while the acceleration "a" is equal to −0.75a. $S_{DTG}$ is the distance traveled while under the direction of the distance-to-go pattern, and $S_L$ is the landing distance.

The total travel distance as a function of maximum speed:

$$S_{TOT} = S_1 + S_{acc} + S_2 + SLDN \tag{3}$$

$$S_1 + S_2 = V_x\left(\frac{a}{J}\right) \tag{4}$$

$$S_{acc} = \frac{V_x}{2}\left(\frac{V_x - 2K_1}{a}\right) \tag{5}$$

$$\text{where } K_1 = \frac{1}{2}J\left(\frac{a}{J}\right)^2$$

Combining:

$$S_{TOT} = V_x\left(\frac{a}{J}\right) + \frac{V_x^2}{2a} - \frac{2K_1V_x}{2a} + SLDN, \text{ or} \tag{6}$$

$$S_{TOT} = V_x\left(\frac{a}{J} - \frac{K_1}{a}\right) + \frac{V_x^2}{2a} + SLDN \tag{7}$$

Using
a=3.75 ft./sec.$^2$
J=7.5 ft./sec.$^3$
$K_1$=0.9375

$$S_{TOT} = .25V + \frac{V_x^2}{7.5} = SLDN \tag{8}$$

$$SLDN = C_9V_x^2 + C_{14}V_x + C_{15} \text{ (from equation (20))} \tag{9}$$

$$S_{TOT} = .267V_x^2 + .809V_x + .423 \tag{10}$$

$$V_x = \sqrt{2.295 + 3.745\,(S_{TOT} - .423)} - 1.515 \tag{11}$$

$S_{TOT}$ is known, e.g. $S_{TOT}$=HL=|STPOS−AVP16|. So $V_x$ may be easily determined.

The decision speed is related to $V_x$ by the following:

$$V_D = V_X - \frac{a^2}{2J} \tag{12}$$

$$V_D = V_x - K_{16} \text{ where: } K_{16} = \frac{a^2}{2J} = .9375 \tag{13}$$

Figure 10:
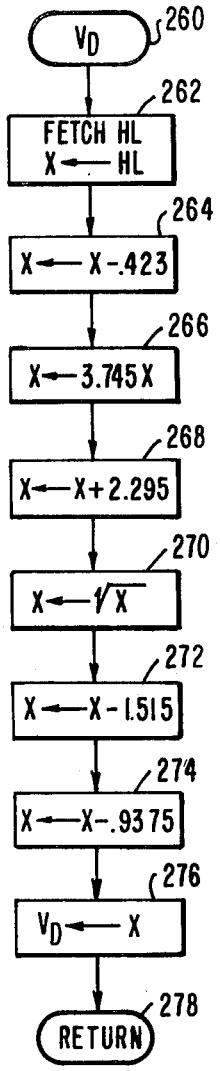
FIG. 10 is a flow chart of a subroutine setting forth the calculation of the decision speed $V_D$ performed in module PGINIT.

FIG. 10 is a subroutine called by step 246 of FIG. 8 which sets forth a step-by-step implementation of equations (11) and (13) to produce the decision speed $V_D$. The calculation is entered at 260 and step 262 fetches HL, which is the same as $S_{TOT}$ in equation (11). The value HL is stored at a location x in RAM 86. Step 264 subtracts 0.423 from x, providing a new value for x, which is multiplied by 3.745 in step 266. The value of 2.295 is added to the lastest value of x, and step 270 takes the square root of the result. Step 272 substracts 1.515 from the square root value, to produce $V_x$, and step 274 subtracts $K_{16}$ or 0.9375, to produce $V_D$. Step 276 stores the value of x at the location reserved for $V_D$, and the subroutine exists at 278 to return to step 248 of FIG. 8.

Figure 11:
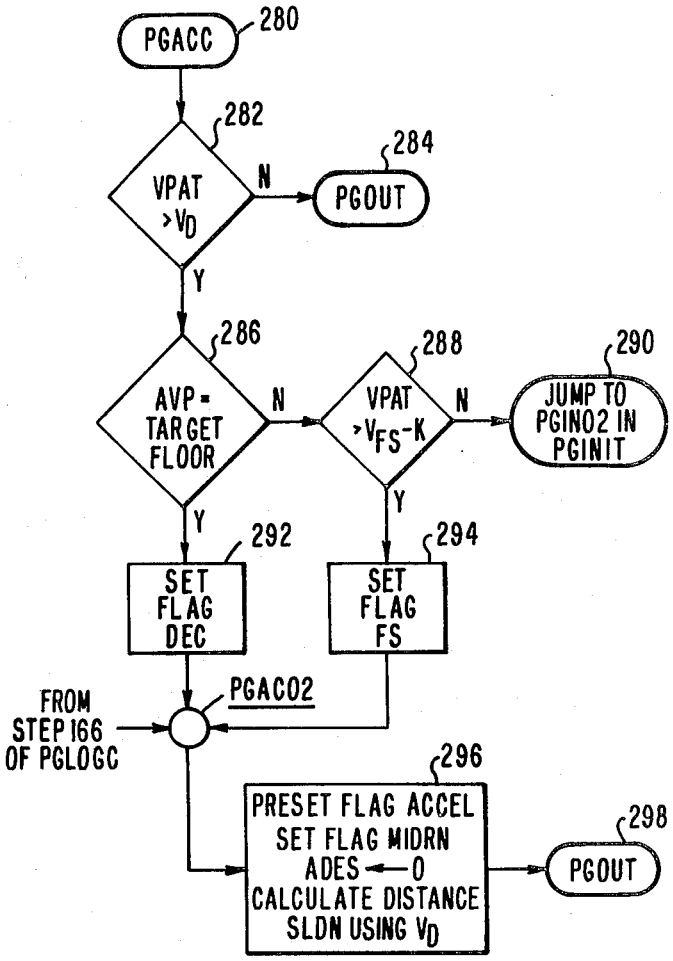
FIG. 11 is a flow chart of function module PGACC which is called by module PGLOGC during the acceleration phase of the run to determine when the speed pattern reaches the latest decision speed $V_D$, to make certain decisions when the speed pattern reaches $V_D$, and to calculate the slowdown distance SLDN when a decision is made to reduce acceleration to zero.

Since step 252 of module PGINIT set flag ACCEL, step 146 of module PGLOGC will transfer control of the speed pattern generator to module PGACC the next time PGLOGC runs. FIG. 11 is a flow chart of module PGACC. Module PGACC is entered at its starting address 280, and step 282 checks to see if VPAT has been increased to the decision speed $V_D$ calculated in step 246 of FIG. 8. If the pattern value has not arrived at the decision speed, there is nothing further to do except to allow module PGTRMP to continue to build the speed pattern value, and the program exits at point 284. Once step 282 finds that VPAT has reached the decision speed $V_D$, module PGACC proceeds with the decision making phase. Step 286 checks E1 in RAM 86 to see if the AVP floor is the target floor. If it is not the target floor, step 288 checks to see if VPAT has reached the speed value of $V_{FS}-K$. If it has not, then the acceleration phase may continue and step 290 jumps to location PGIN02 of module PGINIT to update AVP and HL, and to calculate a new decision speed $V_D$.

If step 286 finds the AVP floor is the target floor, it goes to step 292 which sets a flag DEC. Flag DEC is used by the floor selector for such things as controlling the hall lanterns and the call resets. Step 292 proceeds to program point PGAC02. If step 288 finds VPAT has reached rated speed, step 294 sets a flag FS, which may also be used by the floor selector, and step 294 proceeds to program point PGAC02. Step 166 of module PGLOGC also proceeds to this point. Point PGAC02 proceeds to step 296 which resets the flag ACCEL, it sets flag MIDRN, it sets the desired acceleration rate ADES to zero, and it calculates the slowdown distance SLDN using the lastest value of the decision speed $V_D$. The subroutine in FIG. 12 may be called to calculate SLDN. The slowdown distance SLDN is only calculated once per run, and this fact is another important aspect of the invention.

Referring to FIG. 9, it can be seen that the slowdown distance SLDN is equal to:

$$SLDN = S_D + S_T + S_M + S_{DTG} + S_L \tag{14}$$

$$S_D = V_xT_o \tag{15}$$

where:

$V_x$=maximum speed as a function of total travel distance $T_o$=system time delay $$S_T = V_x \frac{.75a}{J} - \frac{1}{6} J \left( \frac{.75a}{J} \right)^3 \quad (16)$$

where:

a=maximum acceleration, e.g., 3.75 ft/sec.$^2$

J=maximum jerk, e.g., 7.5 ft/sec.$^2$ $$S_m = .1V_x - .1 \left( \frac{1}{2} J \left( \frac{.75a}{J} \right)^2 + \frac{.075a}{2} \right) \quad (17)$$

$$S_{DTG} = \frac{V_x^2 - 2V_xC_5 + C_5^2 - V_f^2}{2a} \quad (18)$$

where:

$V_f$=a constant—the desired car velocity at transfer point between slowdown pattern and landing pattern.

$$C_5 = \frac{1}{2} J \left( \frac{.75a}{J} \right)^2 + .075a$$

Equations (2) through (6) may be combined to provide:

$$(20)\ SLDN = C_9V_x^2 + C_{14}V_x + C_{15}$$

where:

$C_9$=(1/2a)

$C_{14}=C_6+C_7+C_{13}-C_{11}$ $C_{15}=C_4+C_{10}-C_8-C_{12}$ where:

$$C_4 = S_L$$

$$C_5 = \frac{1}{2} J \left( \frac{.75a}{J} \right)^2 + .075a$$

$$C_6 = T_o$$

$$C_7 = \frac{.75a}{J}$$

$$C_8 = \frac{1}{6} J \left( \frac{.75a}{J} \right)^3$$

$$C_9 = \frac{1}{2a}$$

$$C_{10} = \frac{C_5^2 - V_f^2}{2a}$$

$$C_{11} = \frac{C_5}{a}$$

$$C_{12} = .1 \left( \frac{1}{2} J \left( \frac{.75a}{J} \right)^2 + \frac{.075a}{2} \right)$$

$$C_{13} = .1$$

Figure 12:
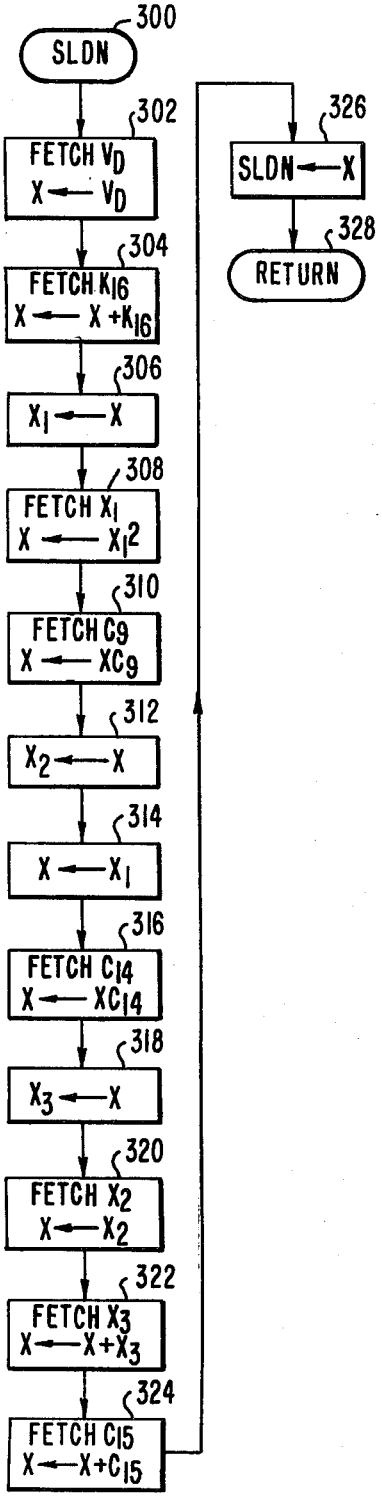
FIG. 12 is a flow chart of a subroutine setting forth the calculation of the distance SLDN performed by module PGACC.

FIG. 12 is a subroutine called by step 296 to perform the calculation SLDN, and it is a direct implementation of equation (20). The subroutine is entered at 300 and step 302 sets a variable x equal to the lastest value of $V_D$. Step 304 adds the value for $K_{16}$ found in ROM 88 to x, and step 306 stores the result at a location $x_1$. Thus, $x_1$ holds $V_x$. Step 308 squares $x_1$ and stores the result at x. Step 310 multiples $C_9$ by x and stores the result at $x_2$. Step 314 obtains $x_1$ and step 316 multiplies it by $C_{14}$. The result is stored at $x_3$. Step 320 fetches $x_2$, step 322 adds $x_3$, and step 324 adds $C_{15}$. Step 326 stores the result in RAM 86 at the location SLDN, and step 328 returns to step 296 of FIG. 11.

Figure 13:
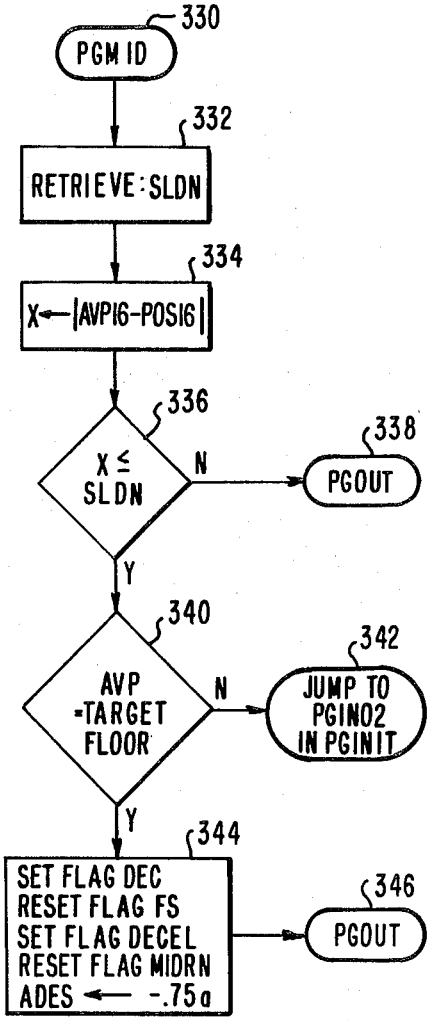
FIG. 13 is a flow chart of a function module PGMID which is called by module PGLOGC to determine when the slowdown phase of the run should start by using the distance SLDN, the distance between the elevator car and the next AVP floor, and the knowledge of when the AVP floor is the target floor.

Step 296 resets flag ACCEL and sets flag MIDRN. Thus, the next time module PGLOGC runs, it will transfer control to module PGMID shown in FIG. 13. Module PGMID is entered at point 330 and step 332 fetches the distance SLDN calculated by step 296 of PGACC. STep 334 determines the distance from the current car position POS16 to the address AVP16 of the AVP floor. Step 336 compares this distance with the distance SLDN. If the car has not reached the slowdown distance for the AVP floor, the program exits at 338 as there is nothing to do until the car reaches this point. When step 336 finds the car has reached the distance SLDN from the AVP floor, step 340 checks E1 in RAM 86 to see if the AVP floor is the target floor. If it is not the target floor, step 342 jumps to program point PGIN02 of module PGINIT to update the AVP floor. On this run through PGINIT, step 218 will find flag MIDRN set and omit the determination of HL and the calculation of $V_D$. When step 340 finds the car has arrived at the distance SLDN from the target floor, step 344 sets flag DEC, used by the floor selector, it resets flag FS, also used by the floor selector, it resets flag MIDRN, and it sets flag DECEL. Thus, when module PGLOGC runs again, it will transfer control to module PGDEC. Deceleration is also initiated by this step by setting ADES to $-\frac{3}{4}$ths of the rated acceleration a.

Figure 14:
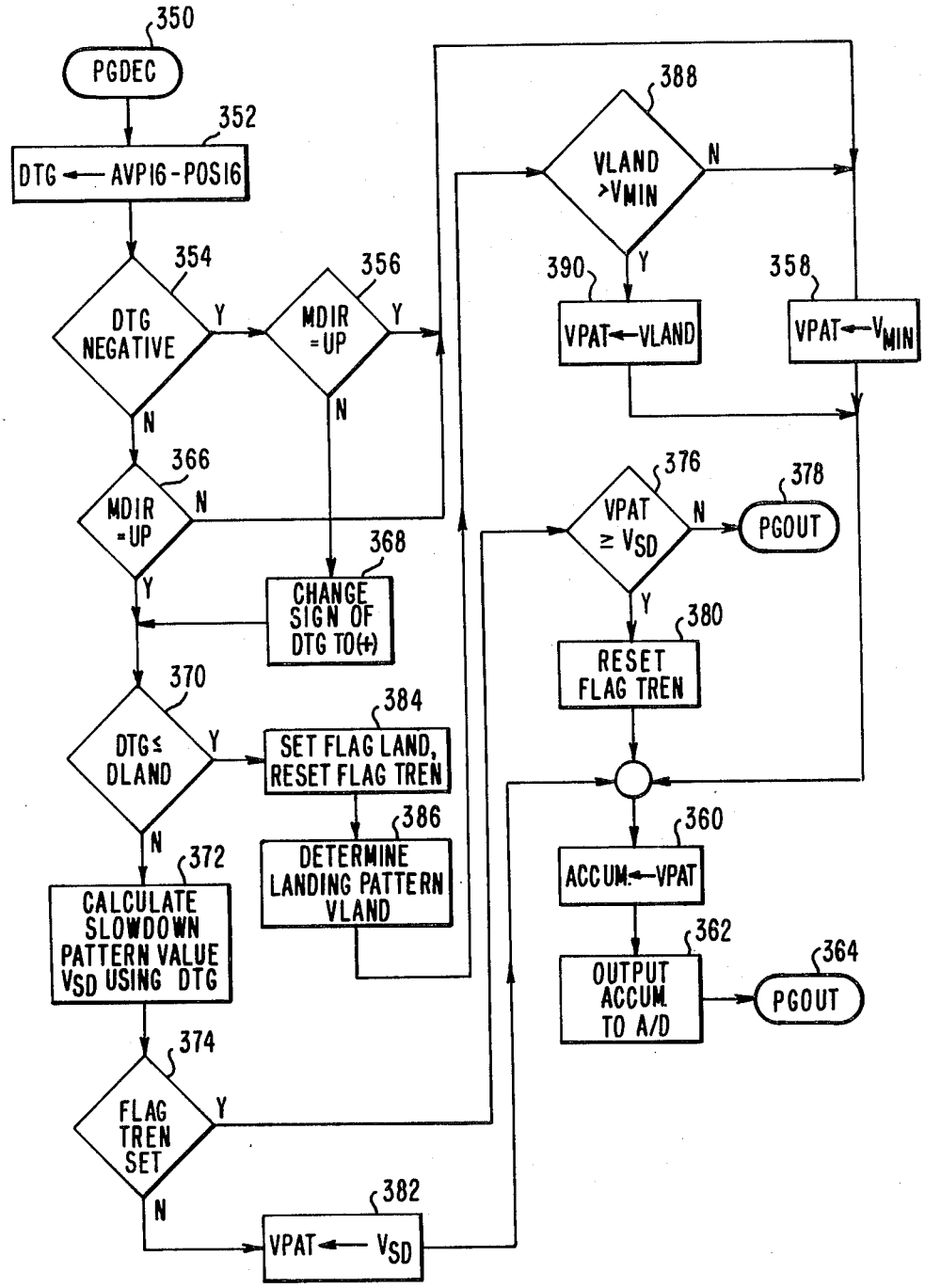
FIG. 14 is a flow chart of a function module PGDEC which is called by module PGLOGC when module PGMID finds the distance SLDN equal to the distance between the elevator car and the target floor, with module PGDEC generating a distance based portion of the speed pattern using the distance-to-go (DTG) in the calculations.

A flowchart for module PGDEC is set forth in FIG. 14. PGDEC is entered at point 350 and step 352 determines the distance-to-go (DTG) from the current position of the elevator car, POS16, to the address AVP16 of the AVP floor. Step 354 checks to see if DTG is negative, and step 356 checks the car travel direction. If DTG is negative and the travel is up, the car has passed the AVP floor and step 358 sets the speed pattern value VPAT equal to a predetermined value $V_{MIN}$, which is the minimum landing speed. Step 360 outputs the new value for VPAT to the accumulator, step 362 sends the value in the accumulator to the D/A converter 96, and the program exits at 364. In like manner, if step 354 finds DTG positive, step 366 checks the car travel direction MDIR. If it is down, the car has passed the AVP floor and step 366 proceeds to step 358.

If steps 366 or 356 find the car has not passed the AVP floor, they proceed to step 370, with step 356 first proceeding to step 368 to change the sign of DTG from negative to positive. Step 370 checks to see if the car is within the landing distance DLAND, such as 10 inches, from the level of the target floor. If it is not within the landing distance, step 372 determines the digital value $V_{SD}$ of the desired speed pattern at this point, using the value of the distance-to-go DTG. Step 372 may call the subroutine shown in FIG. 16 to make the calculation. This calculation is made every other interrupt, because COUNT is set to two by step 116 of module PGLOGC, as flag DECEL is now set. This calculation of $V_{SD}$ is not an undue burden on the microcomputer 80, as it has very little to do during this stage, even if it is performing all of the other functions of the car controller 60.

Step 374 then checks to see if the time ramp generator is still enabled. If it is, it means that the pattern generator is still in the time based phase, and step 376 checks to see if the high speed transfer point 102, shown in FIG. 3, has been reached, by determining if VPAT equals or exceeds the value of $V_{SD}$. If the transfer point has not been reached, there is nothing more to do at this time, and the program exits at 378.

When step 376 finds VPAT is equal to or greater than $V_{SD}$, step 380 disables the time ramp generator module PGTRMP by resetting flag TREN, and step 380 proceeds to step 360. The next time module PGDEC runs, step 374 will find flag TREN reset, and it will proceed to step 382 which places the value of $V_{SD}$ in memory location VPAT, to now make the speed pattern responsive to the distance-to-go value $V_{SD}$.

The calculation of the slowdown distance is designed so that ideally the system will decelerate on the time based pattern at ¾ths of the rated value for 0.1 second before the high speed switchover is made. This allows leeway to compensate for the maximum error (0.025 second) in the initiation of slowdown by module PGMID.

When step 370 finds the distance-to-go DTG has reached the landing distance DLAND, the program proceeds to step 384 which sets flag LAND for use by an external program "LAND" shown in FIG. 18, and it resets the flag TREN, which should already have been reset by step 380. If module PGDEC is also to provide the landing pattern, step 386 provides a value for the landing pattern VLAND based on the distance of the car from the floor level. For example, at the ten inch point, the first value in the look-up table for the landing pattern shown in the ROM map of FIG. 4 may be read. Each standard increment of car travel then causes the address of the next location of the look-up table to provide the next digital value of VLAND. Step 386 proceeds to step 388 to make sure VLAND exceeds the minimun landing speed $V_{MIN}$. If it does not, step 388 proceeds to step 358 which sets VPAT equal to $V_{MIN}$. If VLAND exceeds $V_{MIN}$, step 390 sets VPAT to VLAND. If the landing pattern is provided by an auxiliary device, such as by a hatch transducer, then module PGDEC would transfer control to this analog device.

Figure 15:
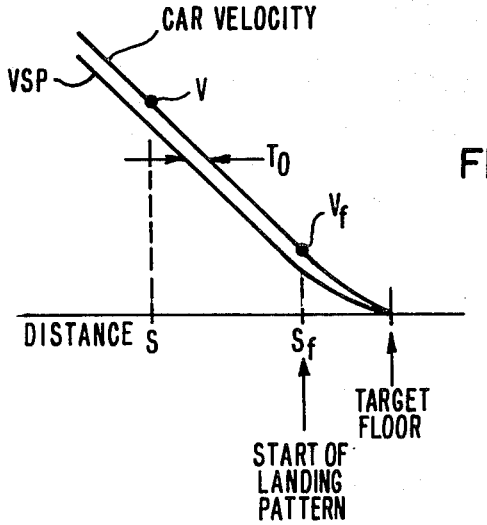
FIG. 15 is a graph which is useful in understanding the derivation of the distance slowdown pattern calculation for determining $V_{SD}$.

FIG. 15 is a graph which is useful in the explanation of how the distance-to-go speed pattern $V_{SD}$ is calculated. $V_f$ is the desired car speed when the car reaches the landing distance $S_f$(DLAND). The slowdown pattern $V_{SD}$ is calculated as follows:

$$S - S_f = \left(\frac{V + V_f}{2}\right)\left(\frac{V - V_f}{|a|}\right) \quad (21)$$

$$S - S_f = \frac{V^2 - V_f^2}{2|a|} \quad (22)$$

$$V^2 = 2|a|(S - S_f) + V_f^2 \quad (23)$$

$$V = \sqrt{2|a|(S - S_f) + V_f^2} \quad (24)$$

$$V_{SD} = V + a\,T_o \quad (25)$$

$$V_{SD} = \sqrt{2|a|(S - S_f) + V_f^2} - |a|T_o \quad (26)$$

$$V_{SD} = \sqrt{2|a|S + V_f^2 - s|a|S_f} - |a|T_o \quad (27)$$

when:

48 distance pulses = 1 foot of travel

Velocity Pattern = 30 bits/ft/sec.

$$S = \frac{DTG}{48}$$

$$V_{SD} = 30\left(\sqrt{2|a|\frac{DTG}{48} + V_f^2 - 2|a|S_f} - |a|T_o\right) \quad (28)$$

$$V_{SD} = \sqrt{900\left(2|a|\frac{DTG}{48} + V_f^2 - 2|a|S_f\right)} - 30\,|a|T_o \quad (29)$$

$$V_{SD} = \sqrt{900\left(2|a|\frac{DTG}{48} + V_f^2 - 2|a|S_f\right)} - 30\,|a|T_o \quad (30)$$

where:

a = constant deceleration rate

DTG = distance to go from car to target floor (48 bits per foot)

$V_f$ = desired car velocity at transfer point between slowdown pattern and landing pattern $S_f$ = distance over which landing pattern is utilized $T_o$ = time delay between speed pattern and actual car speed Distance S = 48 bits per foot Velocity Pattern = 30 bits/ft/sec.

Figure 16:
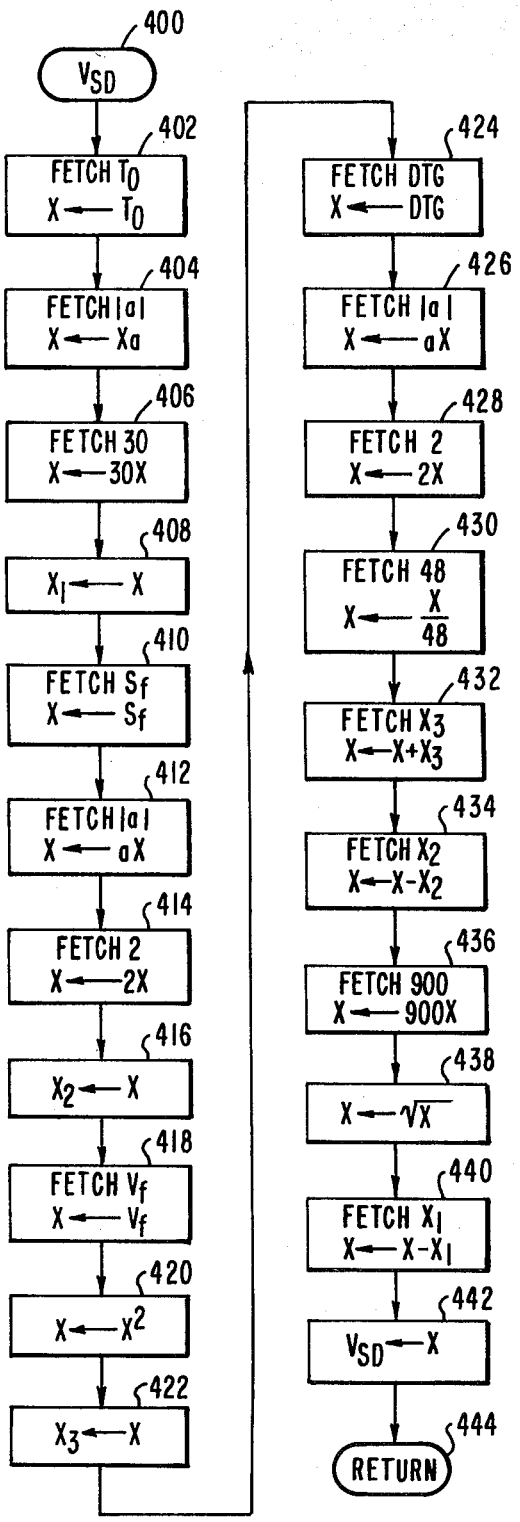
FIG. 16 is a flow chart of a subroutine for performing the calculation which provides $V_{SD}$.

FIG. 16 is a flow chart of a subroutine for calculating $V_{SD}$ which is a straight forward implementation of equation (30). The subroutine is entered at 400 and step 402 fetches the system time delay constant $T_0$ from ROM 88, and it stores this value at location x. Step 404 fetches the absolute value of the acceleration a and it multiplies it by x. Step 406 multiplies the new value of x by 30, and the result is stored in location $x_1$ by step 408.

Step 410 fetches the landing distance $S_f$, and step 412 fetches the absolute value of a and multiplies it by the value of $S_f$. Step 414 multiplies the result by two and step 416 stores the result at $x_2$.

Step 418 fetches the desired landing speed velocity $V_f$ at the low speed transfer point, step 420 squares it, and step 422 stores the result at $x_3$.

Step 424 fetches the distance-to-go value DTG, step 426 fetches the absolute value of the acceleration a and multiplies it by DTG. Step 428 multiplies the result by two, step 430 divides the result by 48 and step 432 adds the value stored in $x_3$ to the result. Step 434 subtracts the value stored in $x_2$ from the result, and step 436 multiplies the result by 900. Step 438 takes the square root of the result, step 440 subtracts the value stored in $x_1$, and step 442 stores the result in location $V_{SD}$ in RAM 86. The subroutine exits at point 444 to return to step 372 of FIG. 14.

When steps 136 and 142 of module PGLOGC find the flag LEVEL set, they each jump to module PGRLVL shown in FIG. 17 to initiate the releveling speed pattern. Module PGRLVL is entered at point 450 and step 452 checks to see if the time ramp module PGTRMP has been enabled. If not, step 452 sets flag TREN to enable module PGTRMP. If step 452 find flag TREN set, it proceeds to step 456 as does step 454, and step 456 checks to see if the pattern value VPAT has reached the leveling speed value $V_{LV}$. If not, step 458 sets the desired acceleration ADES to a and the program exits at 462. If step 456 finds the pattern has reached the leveling speed magnitude, step 456 goes to step 460 which sets the desired acceleration ADES and actual acceleration ACC to zero, and step 460 proceeds to exit point 462.

While FIG. 18 is not part of the speed pattern generator per se, it does set forth an exemplary flow chart for a program LAND which may be called by the priority executive when the flag LAND is set by module PGDEC in step 384. It will also be noted that step 122 of PGLOGC maintains the flag LAND set when the car is sitting at a floor to maintain stretch-of-rope releveling active. The flow chart of FIG. 18 is similar to FIG. 7 of incorporated application Ser. No. 409,687, which arrangement maintains a count LS. Count LS is incremented each time the AVP floor is changed. The count LS is decremented each time the elevator car passes a floor level. The LS count will normally be zero when the car levels with the target floor. If the car undershoots or overshoots the target floor, the LS count and the memorized direction MDIR are used to determine the leveling direction.

More specifically, program LAND is entered at point 470 and step 472 checks to see if logic signals LLU and LLD are both low. These signals are responsive to the conditions of relays LU and LD, respectively, which in turn are responsive to switches 1UL and 1DL, respectively, shown in FIG. 1. If step 472 finds both signals are low, it signifies that the elevator car is precisely at floor level, and step 474 resets the flag RUN, it resets the flag LEVEL, it zeros the count LS, and it resets the flag TREN to disable the time ramp generator module PGTRMP. The program returns to the priority executive at point 476.

When step 472 finds that both signals LLU and LLD are not low, step 478 checks to see if both of these signals are high. If they are, the elevator car is outside of the landing zone, and a leveling direction must be established from the LS count and the memorized travel direction MDIR. Step 480 checks MDIR. If the memorized travel direction is up, step 482 checks the LS count. If the LS count is zero, the up traveling car passed the target floor, and step 482 proceeds to step 484 which sets the travel direction to "down". If step 482 finds the LS count is not zero, the up traveling car did not reach the target floor level and step 482 goes to step 486 which sets the direction circuit to "up".

If step 480 finds the memorized travel direction was down, step 488 checks the LS count. If the LS count is zero, the down traveling car passed the target floor level, and step 488 advances to step 486. If the LS count is not zero, the down traveling car did not reach the level of the target floor, and step 488 goes to step 484.

Steps 484 and 486 both proceed to step 490 which sets the flag LEVEL. Thus, module PGLOGC will run module PGRLVL the next time it runs, to generate the landing speed pattern. Step 492 again checks signals LLU and LLD. If the elevator car is now level with the target floor, step 492 goes to step 474. If the car is not level, the program returns to the priority executive and will be run again, because the flag LEVEL will still be set.

If step 478 finds the car is in the landing zone, but not at floor level, step 494 checks LLU. If LLU is high, step 494 goes to step 486 to set the direction circuit to "up". If LLU is not high, step 496 checks LLD. If LLD is high, the program goes to step 484 to set the direction circuits to "down". Step 496 may be eliminated, if desired, since the "no" branch from step 494 should mean that LLD is high. However, it may be left in the program for a redundant check.

Step 226 in module PGINIT and step 158 in module PGLOGC both jump to a module PGSFLR to provide a speed pattern magnitude for a short run. FIG. 19 is a flow chart for module PGSFLR, which module is entered at point 500. Step 502 determines the distance DTG from the car position POS16 to the position AVP16 of the AVP floor. Step 504 checks to see if the elevator car is close enough to the AVP floor to go into the landing mode. If not, step 504 goes to step 506 to determine if the speed pattern value VPAT has reached a predetermined desired short floor running speed magnitude of $V_{SF}$. If it has not reached the speed $V_{SF}$, the program exits at 508. If step 506 finds VPAT has reached the magnitude of $V_{SF}$, step 510 reduces the acceleration to zero by setting both the desired acceleration ADES and actual acceleration ACC to zero. When step 504 finds the elevator car is within the landing distance from the target floor, step 512 sets flags DEC and DECEL. Thus, module PGLOGC will run module PGDEC and step 370 will also find that the DTG value has reached the landing distance DLAND and proceed as hereinbefore described relative to the landing process.

What I claim is:

1. A method of generating a speed pattern for a run of an elevator car to a target floor, comprising the steps of:

(a) calculating a decision speed on the acceleration portion of a desired speed pattern, (b) providing a speed pattern generator, and (c) changing the output of the speed pattern generator at a predetermined jerk limited rate until the magnitude reaches the magnitude of the calculated decision speed point.

2. The method of claim 1 wherein the step of calculating the decision speed point includes the step of:

(d) determining the travel distance from the starting position of the elevator car to the position of the car when the first decision must be made relative to whether the pattern may continue to be changed at the predetermined jerk limited rate.

3. The method of claim 2 including the step of:

(e) determining whether the pattern may continue to be changed at the predetermined jerk limited rate in response to the pattern magnitude reaching the magnitude of the calculated decision speed point.

4. The method of claim 3 including the step of:

(f) determining the decision speed point when a second decision must be made relative to whether the pattern may continue to be changed at the predetermined jerk limited rate, when step (e) finds the pattern may continue to change.

5. The method of claim 3 including the step of:

(g) reducing the rate of change of the speed pattern to zero when step (e) finds the pattern should not continue to change at the predetermined jerk limited rate.

6. A method of generating a speed pattern for a run of an elevator car to a target floor, comprising the steps of:

(a) determining the distance from the starting position of the elevator car to the closest floor (AVP floor) in the travel direction of the elevator car at which a normal stop may be made, and repeating this step each time the AVP floor changes, (b) calculating a decision speed after each determining step, using the determined distance in the calculation, and (c) generating a speed pattern using the decision speeds.

7. The method of claim 6 wherein step (c) uses each decision speed as the speed value to which the speed patter may change to before a decision is required to stop the elevator car at the AVP floor, or to change the AVP floor.

8. The method of claim 7 including the step of:

(d) determining if the AVP floor is the target floor when the magnitude of the speed pattern equals the latest decision speed.

9. The method of claim 8 including the steps of:

(e) determining if a predetermined desired maximum pattern value has been reached when step (d) finds that the AVP floor is not the target floor, and (f) reducing the rate of pattern change to zero when step (d) finds the AVP floor is the target floor, and also when step (e) finds that the desired maximum pattern value has been reached.

10. The method of claim 9 including the step of:

(g) changing the AVP floor when step (d) finds the AVP floor is not the target floor.

11. The method of claim 10 including the step of:

(h) calculating, once per run, following the step of reducing the rate of pattern change to zero, the desired slowdown distance, using the latest decision speed provided by step (b).

12. The method of claim 11 including the step of:

(i) determining the distance-to-go (DTG) from the elevator car to the AVP floor, after step (g) calculates the desired slowdown distance, (j) updating the DTG as the elevator car moves toward the target floor, (k) comparing the DTG with the desired slowdown distance, (l) determining if the AVP floor is the target floor when step (k) finds the DTG equals the desired slowdown distance, (m) initiating a slowdown phase of the speed pattern when step (l) finds the AVP floor is the target floor, and (n) changing the AVP floor when step (l) finds the AVP floor is not the target floor.

13. A method of generating a speed pattern for a run of an elevator car to a target floor, comprising the steps of:

(a) enabling a time based speed pattern generator to provide a speed pattern at the start of the run, (b) determining the distance from the starting location of the elevator car to the closest floor in the travel direction in the elevator car at which the elevator car can make a normal stop (AVP floor), (c) calculating a decision speed based on the distance determined by step (b), (d) changing the magnitude of the speed pattern at a predetermined rate of change until the speed pattern reaches said decision speed, (e) determining if the AVP floor is the target floor when the speed pattern reaches the decision speed, (f) changing the AVP floor when step (e) finds the AVP floor is not the target floor, (g) determining if the decision speed has reached a desired maximum value, and repeating steps (b), (c), (d), (e), (f) and (g) until step (e) finds the AVP floor is the target floor, or step (g) finds the decision speed has reached the desired magnitude.

14. The method of claim 13 including the step of:

(h) calculating the slowdown distance for the elevator car according to a predetermined deceleration schedule, using the last decision speed determined by step (c) in the calculation when the step (e) finds the AVP floor is the target floor, or when step (g) finds the decision speed has reached the desired maximum value.

15. The method of claim 14 including the steps of:

(i) comparing the slowdown distance with the distance from the elevator car to the AVP floor, after the speed pattern has reached the desired maximum value, (j) determining if the AVP floor is the target floor when the comparison step (i) finds the compared distances to be equal, and (K) changing the AVP floor when the AVP floor is not the target floor.

16. The method of claim 15 including the step of:

(l) providing a distance based speed pattern having a predetermined constant deceleration rate a when either step (e) or step (j) finds the AVP floor is the target floor, based upon the distance-to-go (DTG) to the target floor, (m) causing the time based speed pattern to have a predetermined deceleration rate which is less than a, and (n) switching from the time based speed pattern to the distance based speed pattern when the time based speed pattern and distance based speed patterns are equal to one another.

17. A method of generating a speed pattern, comprising the steps of:

generating a digital, time based speed pattern at a first predetermined update rate, checking, at a second predetermined rate which is less than the first predetermined rate, to determine if a parameter of the time based speed pattern should be changed, changing a parameter of the time based speed pattern, as required, in response to said checking step, generating a digital, distance based speed pattern at a third predetermined update rate, which is slower than the first predetermined rate and faster than the second predetermined rate, providing a d/a converter, connecting the d/a converter to the time based digital speed pattern to provide an analog speed pattern signal, and switching the d/a converter to the distance based speed pattern when the time based speed pattern and distance based speed patterns have a predetermined relationship.

18. A method of generating a speed pattern for a run of an elevator car, comprising the steps of:

providing a time ramp generator which provides a speed pattern, providing a plurality of modules, each of which provides commands for controlling the time ramp generator during a selected portion of the speed pattern, and providing a control module which interprets commands to the pattern generator, which monitors the current status of the pattern generator, and which transfers control of the time ramp generator to selected modules according to the specific function required of the speed pattern generator at any given instant.

19. A speed pattern generator for use by an elevator car as it makes a run to a target floor, comprising:

a time ramp generator which provides a speed pattern, a plurality of control modules, each of which, when activated, provides commands for the time ramp generator suitable for controlling predetermined parameters thereof during a selected portion of the speed pattern, and a logic module which monitors the speed pattern and selectively activates the control modules.

20. The speed pattern generator of claim 19 including a slowdown control module which provides a distance based speed pattern based upon the distance-to-go from the elevator car to the target floor, with the logic module activating the slowdown control module when the elevator car approaches the target floor, switching from the speed pattern provided by the time ramp generator to the speed pattern provided by the slowdown control module.

21. The speed pattern generator of claim 19 including a leveling control module which is activated by the logic module when the elevator car is not level with the target floor, with said leveling control module activating the time ramp generator and controlling the time ramp generator to provide a leveling speed pattern.

22. The speed pattern generator of claim 19 wherein the logic module includes means for detecting the need to run the speed pattern generator, and wherein one of the control modules is a speed pattern initiation module which activates the time ramp generator, with the logic module selecting the speed pattern initiation module when it detects the need to run the speed pattern generator.

23. A speed pattern generator for use by an elevator car as it makes a run to a target floor, comprising:

first means for determining the advanced floor position (AVP floor) of the elevator car, second means for determining the distance from the starting position of the elevator car to the AVP floor each time the AVP floor is changed by said first means, third means for calculating a decision speed based upon the distance determined by said first means, fourth means providing a time based speed pattern, and fifth means changing the magnitude of the time base speed pattern at a predetermined rate towards each decision speed provided by said third means.

24. The speed pattern generator of claim 23 including sixth means for detecting when the magnitude of the speed pattern reaches a decision speed provided by the third means, seventh means for determining if the AVP floor is the target floor when the sixth means detects equality, and eighth means for reducing the rate of pattern changing to zero when the seventh means finds the AVP floor is the target floor.

25. The speed pattern generator of claim 24 including ninth means for comparing the decision speed when calculated with a predetermined constant indicative of the maximum desired value for the speed pattern, and tenth means for setting the decision speed to equal the predetermined constant when the ninth means finds the calculated decision speed exceeds the predetermined constant.

26. The speed pattern generator of claim 25 including eleventh means for calculating the desired slowdown distance, using the latest decision speed provided by the third means, when the eighth means reduces the rate of pattern change to zero.

27. The speed pattern generator of claim 26 including means for determining the distance-to-go (DTG) from the elevator car to the AVP floor, after the eleventh means provides the desired slowdown distance, means for comparing the DTG with the desired slowdown distance, and means for initiating a slowdown phase of the speed pattern when the comparison finds equality.

* * * * *